US006909410B2

(12) United States Patent
Kawasaki et al.

(10) Patent No.: US 6,909,410 B2
(45) Date of Patent: Jun. 21, 2005

(54) DRIVING CIRCUIT FOR A LIGHT-EMITTING ELEMENT

(75) Inventors: Somei Kawasaki, Saitama (JP); Masanobu Oomura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 487 days.

(21) Appl. No.: 10/228,091

(22) Filed: Aug. 27, 2002

(65) Prior Publication Data

US 2003/0043130 A1 Mar. 6, 2003

(30) Foreign Application Priority Data

Sep. 4, 2001 (JP) ..... 2001-267008

(51) Int. Cl.[7] ..... G09G 3/32
(52) U.S. Cl. ..... 345/82; 345/204
(58) Field of Search ..... 345/82, 39, 42, 345/44, 45, 55, 76, 87, 204

(56) References Cited

U.S. PATENT DOCUMENTS 5,502,419 A 3/1996 Kawasaki et al. ..... 332/109
5,629,696 A 5/1997 Kawasaki et al. ..... 341/101
6,661,397 B2 * 12/2003 Mikami et al. ..... 345/76
6,750,833 B2 * 6/2004 Kasai ..... 345/76
6,778,154 B2 * 8/2004 Van Velzen ..... 345/76

* cited by examiner

*Primary Examiner*—Henry N. Tran
*Assistant Examiner*—Jean Lesperance
(74) *Attorney, Agent, or Firm*—Fitzpatrick, Cella, Harper & Scinto

(57) ABSTRACT

A driving circuit for a light-emitting element, in which it is possible to exactly control a current flown in the light-emitting element, and perform a stable operation while reducing a power-supply voltage as low as possible, is provided. The driving circuit includes a current supply circuit and a driving control circuit in which, based on a current flown from a supply transistor for supplying a current for driving the light-emitting element, and information relating to a source-drain voltage of the supply transistor, it is possible to perform control so that the current approaches a desired setting current value, and the source-drain voltage of the supply transistor has the same value when setting the voltage of the gate-terminal and when driving the light-emitting element.

11 Claims, 19 Drawing Sheets

DRIVING CIRCUIT FOR A LIGHT-EMITTING ELEMENT

BACKGROUND OF THE INVENTION

1. Field of the Invention

The present invention relates to a driving circuit for a current-control-type light emitting element in which emission luminance is controlled by a current flowing through the element.

2. Description of the Related Art

In a recent situation in which attention has been paid, for example, to self light emitting displays using light emitting elements, the application and development of organic electroluminescent (EL) elements, serving as current-control-type light emitting elements in which emission luminance is controlled by a current flowing through each element, have drawn great interest, and many proposals have been made for driving circuits for such elements. In such driving circuits, it is necessary to supply, precisely, each light emitting element with a desired current. The situation is the same for driving circuits for current-control-type light emitting elements other than driving circuits for organic EL elements.

FIG. 17 is a schematic diagram illustrating a monochromatic image display panel in which light emitting elements are used in an image display unit and arranged on a two-dimensional plane. On an image display unit 4 are arranged x×y current supply circuits 1, each including a light emitting element. Accordingly, the number of horizontal pixels is x, and the number of vertical pixels is y. Column-driving control circuits 2*i*–2*x* are connected to corresponding current supply circuits (columns), and each of column driving signals Ai–Ax sets an injection current for controlling a desired amount of light emission in a corresponding current supply circuit 1. Row-selection-signal generation units 3*i*–3*y* output row control signals Bi–By, each for controlling a selection circuit included in the current supply circuit 1 of the corresponding row to which an output signal is input, so that an operation of setting an injection current in a corresponding one of the column-driving control circuits 2*i*–2*x* is always performed only for one pixel. The number of the column driving signals Ai–Ax and the number of the row control signals Bi–By may be at least one.

(Conventional Example 1 of the Current Supply Circuit 1)

FIG. 14 illustrates a current supply circuit 1*a*, serving as a current supply circuit included in a driving circuit for a light emitting element. The source terminal $M3_S$ (a source terminal is represented by a subscript suffix S in this specification) of a p-type transistor M3, serving as a transistor for supplying current, is connected to a power supply VCC, and a capacitor C1 is connected between the gate terminal $M3_G$ (a gate terminal is represented by a subscript suffix G in this specification) of the p-type transistor M3 and the power supply VCC. The drain terminal $M3_D$ (a drain terminal is represented by a suffix D in this specification) of the p-type transistor M3 is connected to a first terminal of a light emitting element EL. A second terminal of the light emitting element EL is grounded (GND). The gate terminal $M3_G$ is connected to the drain terminal $M1_D$ of a transistor M1, serving as a control switch for controlling a gate-terminal voltage. A control voltage Vd for setting a current value of the transistor M3 is input to the source terminal $M1_S$ of the transistor M1, and a control signal S7 is input to the gate terminal $M1_G$ of the transistor M1. In the case of FIG. 17, the column driving signals Ai–Ax correspond to the control voltage Vd, the row control signals Bi–By correspond to the control signal S7. When the control signal S7=L, the transistor M1=ON, so that the capacitor C1 is charged by the control voltage Vd, and the transistor M3 causes the light emitting element to emit light by injecting a current by a gate-terminal voltage Vg (=Vd). When S7=H, the transistor M1=OFF, so that the gate terminal $M3_G$ is held to the gate-terminal voltage Vg, and the light-emitting element continues to emit light by the gate-terminal voltage Vg. Each of the transistors M3 and M1 comprises a thin-film transistor (TFT), and the capacitor C1 is also formed according to a thin-film forming process. The capacitor C1 may comprise a parasitic capacitance of the transistors M3 and M1.

(Conventional Example 2 of the Current Supply Circuit 1)

FIG. 15 illustrates a current supply circuit 1*b*, serving as a current supply circuit included in a driving circuit for a light emitting element EL. The current supply circuit 1*b* differs from the current supply circuit 1*a* in the following points. The gate terminal $M25_G$ of a p-type transistor M25 having the same current driving characteristics as those of the transistor M3 is connected to the gate terminal $M3_G$ the transistor M3. The source terminal $M25_S$ of the transistor M25 is connected to a power supply VCC. The drain terminal $M25_G$ of the transistor M25 is connected to the source terminal $M26_S$ of a transistor M26. The drain terminal $26_D$ of the transistor M26 is connected to the gate terminal $25_G$. A control signal S8 is input to the gate terminal $M26_G$ of the transistor M26. The drain terminal $M1_D$ of a transistor M1 is connected to the source terminal $M26_S$. A control current Id for setting the amount of light emission is input to the source terminal $M1_S$ of the transistor M1, and a control signal S7 is input to the gate terminal $M1_G$ of the transistor M1. In the case of FIG. 17, the column driving signals Ai–Ax correspond to the control current Id, and the row control signals Bi–By correspond to the control signals S8 and S7. When S7=L and S8=L, the transistor M1=ON and the transistor M26=ON, so that a current mirror circuit consisting of the transistors M25 and M3 is obtained. At that time, when the control current Id is supplied, the current Id flows in the transistor M25, so that the voltage of the gate terminal $M3_G$ is determined by the current driving characteristics of the transistor M25, the capacitor C1 is charged to the voltage of the gate terminal $M3_G$, and a current relating to the control current Id flows in the transistor M3 to cause the light emitting element to emit light by current injection. When S7=H and S8=H, the transistor M1=OFF and the transistor M26=OFF, so that the charged voltage of the capacitor C1 is held, a current relating to the control current Ld flows in the transistor M3, and the light emitting element continues light emission in a set state. Each of the transistors M3, M1, M25 and M26 comprises a thin-film transistor (TFT), and the capacitor C1 is also formed according to a thin-film forming process. The capacitor C1 may comprise a parasitic capacitance of the transistors M3, M25 and M26.

(Conventional Example 3 of the Current Supply Circuit 1)

FIG. 16 illustrates a current supply circuit 1*c*, serving as a current supply circuit included in a driving circuit for a light emitting element. The current supply circuit 1*c* differs from the current supply circuit 1*b* in the following points. The gate terminal $M3_G$ of the transistor M3 is connected to the drain terminal $M26_D$ of the transistor M26. The drain terminal $M3_D$ of the transistor M3 is connected to the source terminal $M26_S$ of the transistor M26. A control signal S8 is input to the gate terminal $M26_G$ of the transistor M26. The drain terminal $M3_D$ is connected to the source terminal $M27_S$ of a transistor M27. The drain terminal $M27_D$ of the transistor M27 is connected to a first terminal of the light emitting element, and a control signal S9 is input to the gate terminal $M27_G$ of the transistor M27. In the case of FIG. 17, the column driving signals Ai–Ax correspond to the control current Id, and the row control signals Bi–By correspond to the control signals S7, S8 and S9. When S7=L, S8=L and S9=H, the transistor M1=ON, the transistor M26=ON and the transistor M27=OFF, so that the transistor M3 operates as a bias voltage circuit receiving the control current Ld, and the light emission of the light emitting element is turned off. The capacitor C1 is charged to the voltage of the gate terminal $M3_G$ determined by the current driving characteristics of the transistor M3. When S1=H, S8=H and S9=L, the transistor M1=OFF, the transistor M26=OFF and the transistor M27=OFF, so that the voltage of the gate terminal $M3_G$ is held to the charged voltage of the capacitor C1, and a current relating to the control current Ld continues to flow in the transistor M3, to cause the light emitting element to emit light. Each of the transistors M1, M3, M26 and M27 comprises a thin-film transistor (TFT), and the capacitor C1 is also formed according to a thin-film forming process. The capacitor C1 may comprise a parasitic capacitance of the transistors M1, M3 and M26.

In the above-described conventional examples, each of the transistors M1, M26 and M27 may have any configuration, provided that the transistor can perform a switching operation by appropriately inputting a corresponding one of the control signals S7, S8 and S9. An n-type transistor may also be used instead of each of the p-type transistors M3 and M25 if connection to the light emitting element, the power supply VCC, the GND and the like is appropriately changed.

FIGS. 18A–18F show time charts, each illustrating an operation of the image display panel shown in FIG. 17. FIG. 18A indicates a control signal S(n) for the n-th row. In order to simplify explanation, it is assumed that the current supply circuits 1 for the n-th row assume a mode of setting an injection current Ir(n) for the n-th row at an L level. During a period T(n), the row control signal S(n)=L, and as shown in FIG. 18C, a corresponding one of the current supply circuits 1 for the n-th row assumes a setting mode for causing the injection current Ir(n) to flow in the corresponding light emitting element. When the the period T(n) has elapsed, the row control signal S(n) changes to an H level, and the current supply circuit 1 for the n-th row continues to cause the injection current Ir(n) to flow in the light emitting element. When an allowance period Ta(n) has elapsed, then during a period T(n+1), as shown in FIG. 18B, the row control signal S(n+1)=L, and, as shown in FIG. 18D, a corresponding one of the current supply circuits 1 for the (n+1)-th row assumes a setting mode for causing an injection current Ir(n+1) to flow in the corresponding light emitting element. When the period (n+1) has elapsed, the row control signal S(n+1) changes to the H level, and the current supply circuit 1 for the n-th line continues to cause the injection current Ir(n+1) to flow in the light emitting element.

However, the above-described current supply circuits 1*a*–1*c* are not without problems.

For example, in conventional example 1, the amount of light emission in the respective current supply circuits 1*a* of the image display unit in which TFT's are arranged on a large area varies due to variations in the current driving characteristics, mainly Vth, of the transistor M3, resulting in incapability of reproducing a stable image on the display panel.

In conventional examples 2 and 3, the above-described problem of variations is improved by driving the supply transistor by the gate-terminal voltage obtained by causing the control current Id to flow. However, since the Vds when setting a current by the control current Id and the Vds when holding light emission (for example, in the case of the current supply circuit 26, the Vds of the transistor M25 when setting a current and the Vds of the transistor M3 when holding light emission) differ, the flow of the same current as Id in the transistor M3 cannot be guaranteed due to the Early effect.

Furthermore, it is necessary to set the voltage value of the power supply VCC with a large margin. Consequently, the influence of variations (longer than the frame period) of the power supply voltage VCC is also present, and the reproduction of a stable image cannot be guaranteed. For the following reasons it is necessary to set the voltage value of the power supply VCC with a large margin.

(Reason 1)

The transistor M3 must be operated in a region other than a triode-characteristic region (Vds<(Vgs−Vth)) where the current driving characteristics largely vary depending on the drain-source voltage Vds. That is, the transistor M3 must be operated at least in a pentode-characteristic region (Vds>(Vgs−Vth)). Accordingly, there is a limitation in the Vds of the transistor M3, and the voltage of the power supply VCC must be larger than the operating voltage of the light emitting element.

(Reason 2)

Even if the transistor M3 is operated in the pentode-characteristic region, a larger Vds is required for the transistor M3 in order to prevent the Early effect in which the current driving characteristics largely vary depending on the value of the Vds. Accordingly, a further larger value is required for the voltage of the power supply VCC.

(Reason 3)

Organic EL elements are degraded as the accumulated value of light emission increases, and the operational voltage of light emission tends to increase. Accordingly, the voltage of the power supply voltage VCC must be still further larger.

Since the voltage of the power supply VCC must be considerably larger than the operational voltage of light emitting elements, the heat generated due to the power consumption of the TFT circuits is transmitted to light emitting elements disposed near (above or below, or to the left of or to the right of) the TFT circuits, resulting in accelerated degradation of organic EL elements which are not heat resistant.

SUMMARY OF THE INVENTION

The present invention has been made in consideration of the above-described problems.

The present invention may provide a driving circuit for a light emitting element in which it is possible to more precisely control a current to be supplied to a light emitting element, and allow a stable operation by setting a power supply voltage to a value as low as possible.

According to one aspect of the present invention, a driving circuit for a current-control-type light emitting element having an emission luminance controlled by a current flow in the light emitting element includes a current supply circuit and a driving control circuit. The current supply circuit is configured to supply a current to the light emitting element and includes: a supply transistor; a driving switch; a reference switch; a control switch; and a capacitor. The driving control circuit controls the current supply circuit. A first terminal of the supply transistor is connected to a first power supply, a second terminal of the supply transistor is connected to a first terminal of the light emitting element via the driving switch and to the driving control circuit via the reference switch, a second terminal of the light emitting element is connected to a second power supply, a gate terminal of the supply transistor is connected to the driving control circuit via the control switch and to a first terminal of the capacitor, and a second terminal of the capacitor is connected to the first terminal of the supply transistor. A path of a current supplied from the first power supply via the supply transistor can be switched between one of a path of an injection current into the light emitting element and a path of a reference current into the driving control circuit, by the driving switch and the reference switch, and a supply-terminal voltage that is a voltage of the second terminal of the supply transistor can be input to the driving control circuit via the reference switch. Based on the reference current and the supply-terminal voltage input via the reference switch during a reference period in which the driving switch is in an off-state, the reference switch is in an on-state, and the control switch is in an off-state, and the supply-terminal voltage input via the reference switch during a driving period in which the driving switch is in an on-state, the reference switch is in an on-state, the control switch is in an off-state, and a current supplied from the first power supply via the supply transistor flows in the light emitting element as the injection current, the driving control circuit controls a gate-terminal voltage of the supply transistor via the control switch, so that the reference current during the reference period approaches a desired setting current value and that the supply-terminal voltage during the reference period approaches the supply terminal voltage during the driving period.

According to another aspect of the present invention, a driving circuit for a current-control-type light emitting element having an emission luminance controlled by a current flow in the light emitting element include a current supply circuit and a driving control circuit. The current supply circuit that supplies a current to the light emitting element includes: a supply transistor having electric characteristics; a reference transistor having the electric characteristics of the supply transistor; a first reference switch; a second reference switch; a control switch; and a capacitor. The driving control circuit controls the current supply circuit. A first terminal of the supply transistor is connected to a first power supply, a second terminal of the supply transistor is connected to a first terminal of the light emitting element and to the driving control circuit via the second reference switch, a second terminal of the light emitting element is connected to a second power supply, a gate terminal of the supply transistor is connected to a gate terminal of the reference transistor, to the driving control circuit via the control switch and to a first terminal of the capacitor, a second terminal of the capacitor is connected to the first terminal of the supply transistor, a first terminal of the reference transistor is connected to the first power supply, and a second terminal of the reference transistor is connected to the driving control circuit via the first reference switch. A reference current whose value is the same as an injection current supplied from the first power supply to the light emitting element via the supply transistor can be input to the driving control circuit via the reference transistor, a reference-terminal voltage that is a voltage of the second terminal of the reference transistor can be input to the driving control circuit via the first reference switch, and a supply-terminal voltage that is a voltage of the second terminal of the supply transistor can be input to the driving control circuit via the second reference switch. Based on the reference current and the reference-terminal voltage input via the first reference switch during a reference period in which the first reference switch is in an on-state, the second reference switch is in an off-state and the control switch is in an off-state, and the supply-terminal voltage input via the second reference switch during a driving period in which the first reference switch is in an off-state, the second reference switch is in an on-state, the control switch is in an off-state, and the injection current flows in the light emitting element, the driving control circuit controls a gate-terminal voltage of the supply transistor via the control switch, so that the reference current during the reference period approaches a desired setting current value and that the reference-terminal voltage during the reference period approaches the supply-terminal voltage during the driving period.

According to yet another aspect of the present invention, a method of driving a current-control-type light emitting element having an emission luminance controlled by a current flow in the light emitting element includes the steps of: supplying a current to a light emitting element via a current supply circuit comprising: a supply transistor; a driving switch; a reference switch; a control switch; and a capacitor; and controlling the current supply circuit via a driving control circuit. A first terminal of the supply transistor is connected to a first power supply, a second terminal of the supply transistor is connected to a first terminal of the light emitting element via the driving switch and to the driving control circuit via the reference switch, a second terminal of the light emitting element is connected to a second power supply, a gate terminal of the supply transistor is connected to the driving control circuit via the control switch and to a first terminal of the capacitor, and a second terminal of the capacitor is connected to the first terminal of the supply transistor. A path of a current supplied from the first power supply via the supply transistor can be switched between one of a path of an injection current into the light emitting element and a path of a reference current into the driving control circuit, by the driving switch and the reference switch, and a supply-terminal voltage that is a voltage of the second terminal of the supply transistor can be input to the driving control circuit via the reference switch. Based on the reference current and the supply-terminal voltage input via the reference switch during a reference period in which the driving switch is in an off-state, the reference switch is in an on-state, and the control switch is in an off-state, and the supply-terminal voltage input via the reference switch during a driving period in which the driving switch is in an on-state, the reference switch is in an on-state, the control switch is in an off-state, and a current supplied from the first power supply via the supply transistor flows in the light emitting element as the injection current, the driving control circuit controls a gate-terminal voltage of the supply transistor via the control switch, so that the reference current during the reference period approaches a desired setting current value and that the supply-terminal voltage during the reference period approaches the supply terminal voltage during the driving period.

According to still another aspect of the present invention, a method of driving a current-control-type light emitting element having an emission luminance controlled by a current flow in the light emitting element include the steps of: supplying a current to a light emitting element via a current supply circuit comprising: a supply transistor having electric characteristics; a reference transistor having the electric characteristics of the supply transistor; a first reference switch; a second reference switch; a control switch; and a capacitor; and controlling the current supply circuit via a driving control circuit. A first terminal of the supply transistor is connected to a first power supply, a second terminal of the supply transistor is connected to a first terminal of the light emitting element and to the driving control circuit via the second reference switch, a second terminal of the light emitting element is connected to a second power supply, a gate terminal of the supply transistor is connected to a gate terminal of the reference transistor, to the driving control circuit via the control switch and to a first terminal of the capacitor, a second terminal of the capacitor is connected to the first terminal of the supply transistor, a first terminal of the reference transistor is connected to the first power supply, and a second terminal of the reference transistor is connected to the driving control circuit via the first reference switch. A reference current whose value is the same as an injection current supplied from the first power supply to the light emitting element via the supply transistor can be input to the driving control circuit via the reference transistor, a reference-terminal voltage that is a voltage of the second terminal of the reference transistor can be input to the driving control circuit via the first reference switch, and a supply-terminal voltage that is a voltage of the second terminal of the supply transistor can be input to the driving control circuit via the second reference switch. Based on the reference current and the reference-terminal voltage input via the first reference switch during a reference period in which the first reference switch is in an on-state, the second reference switch is in an off-state and the control switch is in an off-state, and the supply-terminal voltage input via the second reference switch during a driving period in which the first reference switch is in an off-state, the second reference switch is in an on-state, the control switch is in an off-state, and the injection current flows in the light emitting element, the driving control circuit controls a gate-terminal voltage of the supply transistor via the control switch, so that the reference current during the reference period approaches a desired setting current value and that the reference-terminal voltage during the reference period approaches the supply-terminal voltage during the driving period.

According to yet another aspect of the present invention, a computer-readable storage medium storing computer code for executing a method of driving a current-control-type light emitting element having an emission luminance controlled by a current flow in the light emitting element is provided, the method including the steps of: supplying a current to a light emitting element via a current supply circuit comprising: a supply transistor; a driving switch; a reference switch; a control switch; and a capacitor; and controlling the current supply circuit via a driving control circuit. A first terminal of the supply transistor is connected to a first power supply, a second terminal of the supply transistor is connected to a first terminal of the light emitting element via the driving switch and to the driving control circuit via the reference switch, a second terminal of the light emitting element is connected to a second power supply, a gate terminal of the supply transistor is connected to the driving control circuit via the control switch and to a first terminal of the capacitor, and a second terminal of the capacitor is connected to the first terminal of the supply transistor. A path of a current supplied from the first power supply via the supply transistor can be switched between one of a path of an injection current into the light emitting element and a path of a reference current into the driving control circuit, by the driving switch and the reference switch, and a supply-terminal voltage that is a voltage of the second terminal of the supply transistor can be input to the driving control circuit via the reference switch. Based on the reference current and the supply-terminal voltage input via the reference switch during a reference period in which the driving switch is in an off-state, the reference switch is in an on-state, and the control switch is in an off-state, and the supply-terminal voltage input via the reference switch during a driving period in which the driving switch is in an on-state, the reference switch is in an on-state, the control switch is in an off-state, and a current supplied from the first power supply via the supply transistor flows in the light emitting element as the injection current, the driving control circuit controls a gate-terminal voltage of the supply transistor via the control switch, so that the reference current during the reference period approaches a desired setting current value and that the supply-terminal voltage during the reference period approaches the supply terminal voltage during the driving period.

According to still another aspect of the present invention, a computer-readable storage medium storing computer code for executing a method of a current-control-type light emitting element having an emission luminance controlled by a current flow in the light emitting element is provided, the method including the steps of: supplying a current to a light emitting element via a current supply circuit comprising: a supply transistor having electric characteristics; a reference transistor having the electric characteristics of the supply transistor; a first reference switch; a second reference switch; a control switch; and a capacitor; and controlling the current supply circuit via a driving control circuit. A first terminal of the supply transistor is connected to a first power supply, a second terminal of the supply transistor is connected to a first terminal of the light emitting element and to the driving control circuit via the second reference switch, a second terminal of the light emitting element is connected to a second power supply, a gate terminal of the supply transistor is connected to a gate terminal of the reference transistor, to the driving control circuit via the control switch and to a first terminal of the capacitor, a second terminal of the capacitor is connected to the first terminal of the supply transistor, a first terminal of the reference transistor is connected to the first power supply, and a second terminal of the reference transistor is connected to the driving control circuit via the first reference switch. A reference current whose value is the same as an injection current supplied from the first power supply to the light emitting element via the supply transistor can be input to the driving control circuit via the reference transistor, a reference-terminal voltage that is a voltage of the second terminal of the reference transistor can be input to the driving control circuit via the first reference switch, and a supply-terminal voltage that is a voltage of the second terminal of the supply transistor can be input to the driving control circuit via the second reference switch. Based on the reference current and the reference-terminal voltage input via the first reference switch during a reference period in which the first reference switch is in an on-state, the second reference switch is in an off-state and the control switch is in an off-state, and the supply-terminal voltage input via the second reference switch during a driving period in which the first reference switch is in an off-state, the second reference switch is in an on-state, the control switch is in an off-state, and the injection current flows in the light emitting element, the driving control circuit controls a gate-terminal voltage of the supply transistor via the control switch, so that the reference current during the reference period approaches a desired setting current value and that the reference-terminal voltage during the reference period approaches the supply-terminal voltage during the driving period.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

Preferred embodiments of the present invention will now described with reference to the drawings. In the present invention, a first terminal and a second terminal of a transistor indicate two terminals other than the gate terminal, i.e., either the source terminal or the drain terminal. Which of the first and second terminals correspond to the source terminal and the drain terminal depends on conditions, for example, the direction of the current flowing in the circuit, and whether the transistor is a p-type transistor or an n-type transistor. In the following description, one such configuration will be illustrated. A first terminal and a second terminal of a light emitting element, and a first terminal and a second terminal of a capacitor also indicate either ones of respective two terminals. The situation is the same as in the above-described case of the transistor, i.e., the polarity or the like may be appropriately selected depending on a specific circuit configuration.

As for a combination of a first power supply and a second power supply, for example, one of them may have a power-supply potential and another one may have a ground potential, or both of them may have a power-supply potential. Such a combination may be appropriately selected depending on design.

[First Embodiment]

Figure 1:
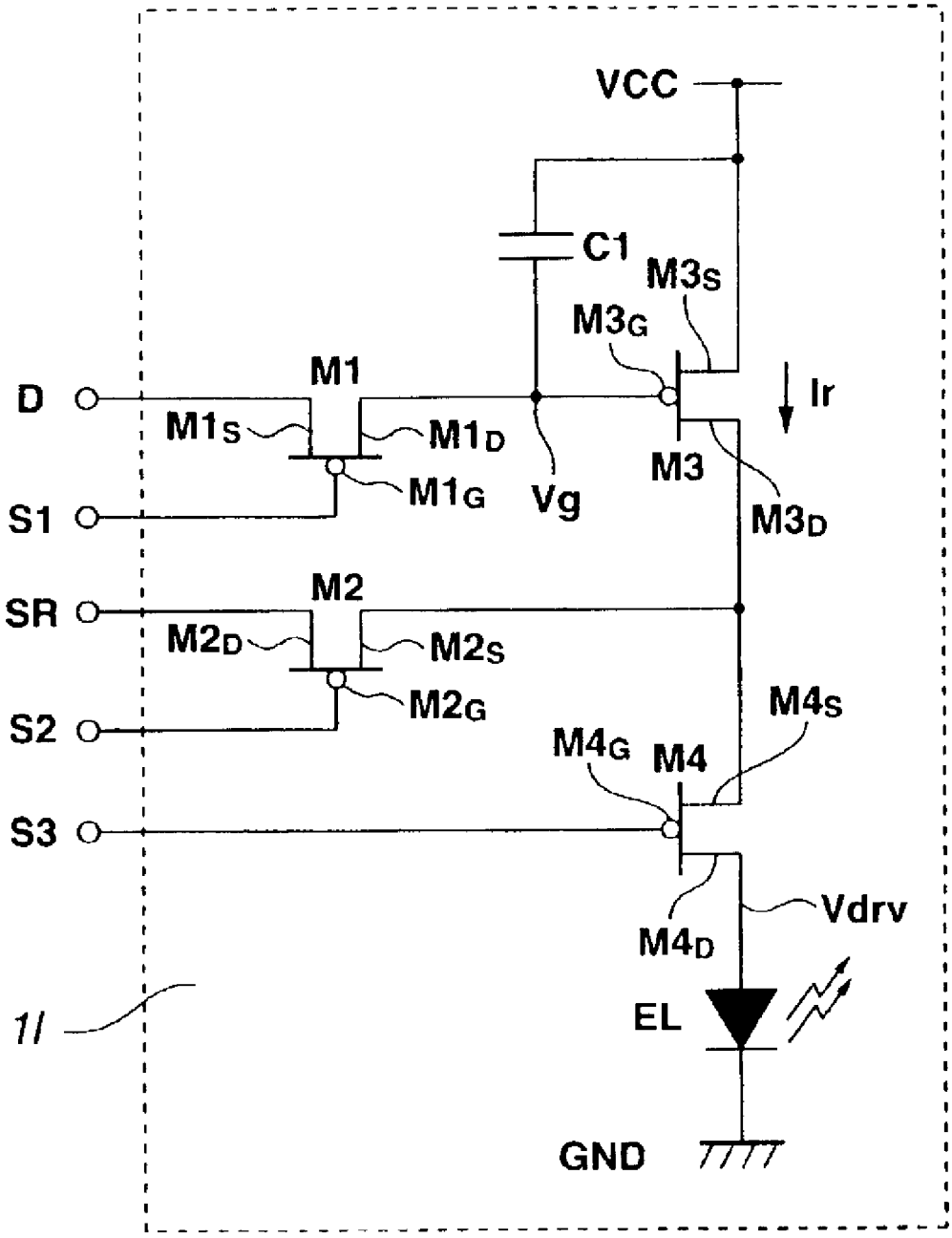
FIG. 1 is a circuit diagram of a current supply circuit included in a driving circuit for a light emitting element according to a first embodiment of the present invention.
Figure 2:
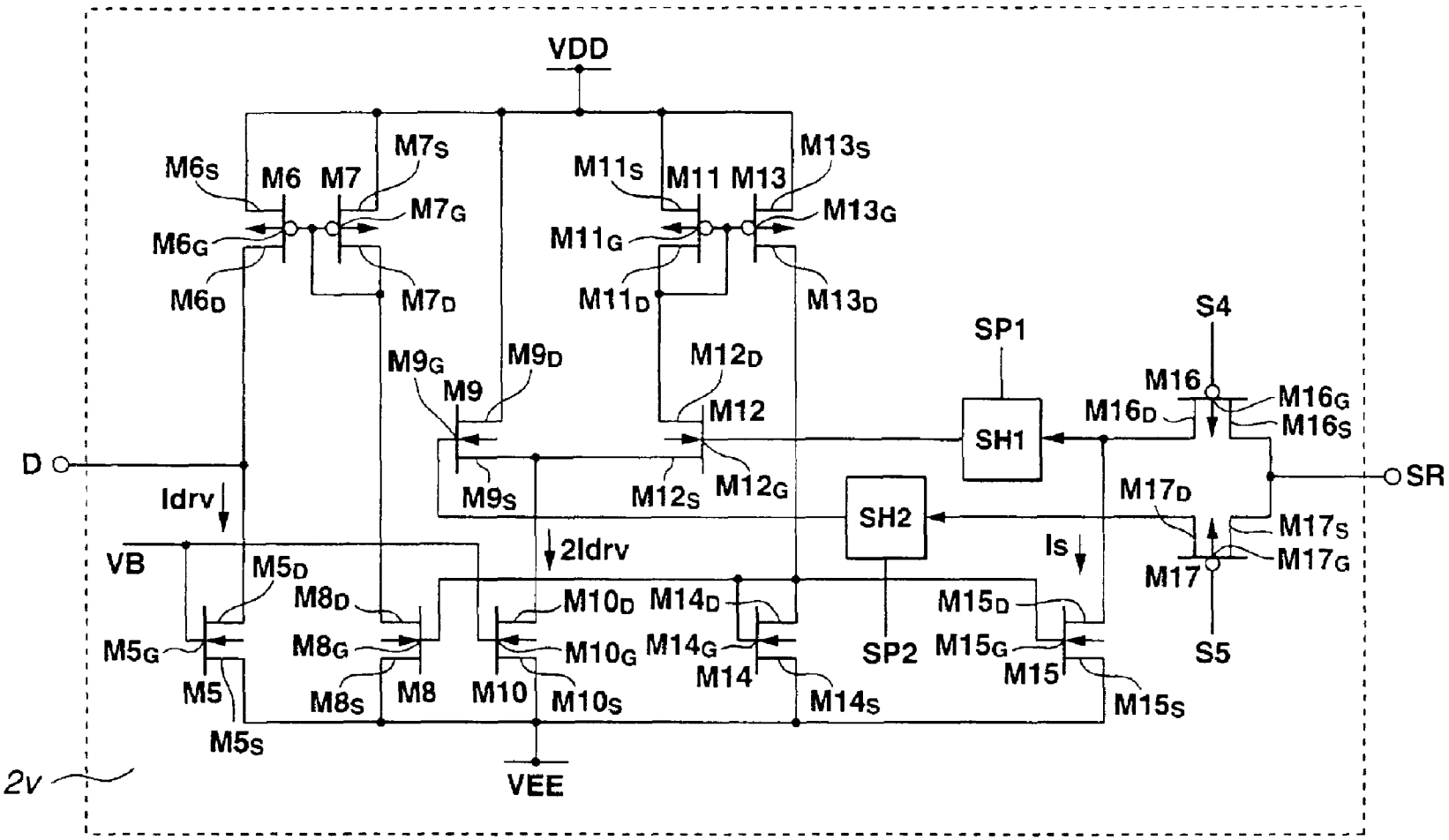
FIG. 2 is a circuit diagram of a driving control circuit included in the driving circuit for the light emitting element according to the first embodiment.
Figure 17:
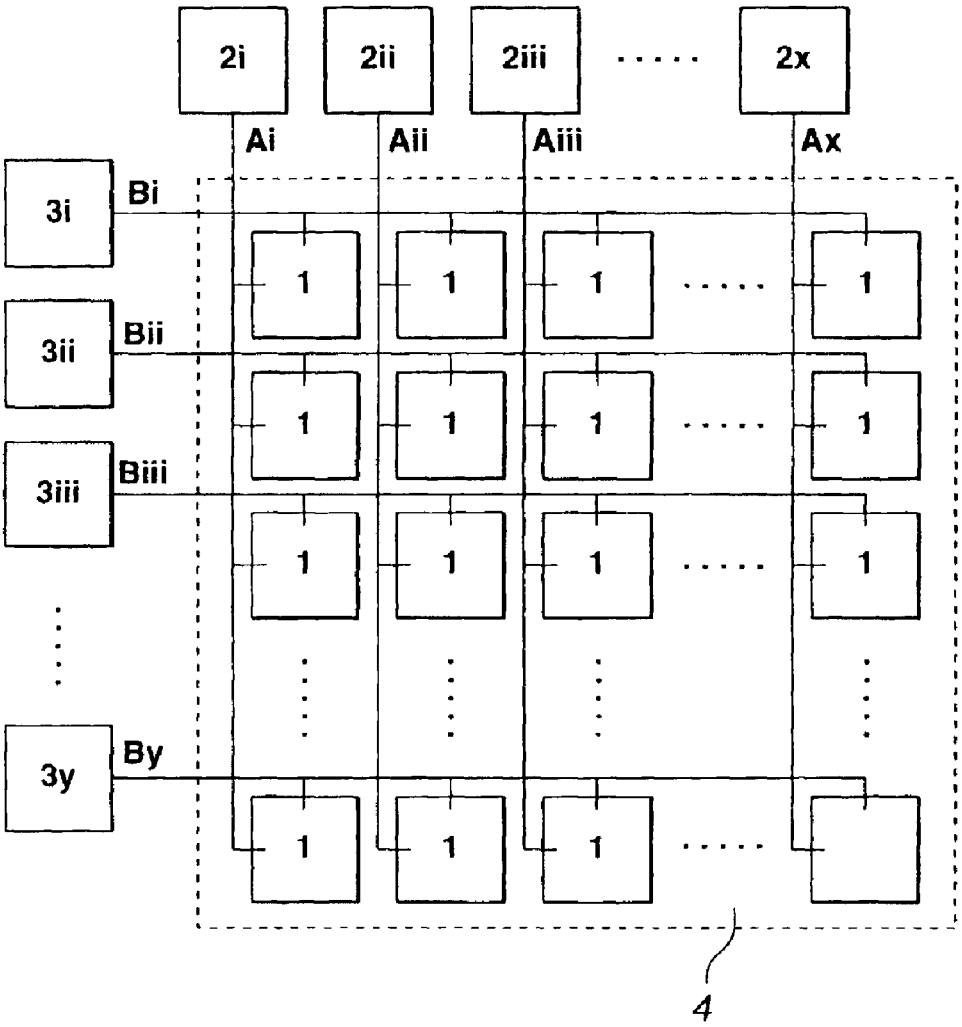
FIG. 17 is a schematic diagram illustrating a monochromatic image display panel.
Figures 18A, 18B, 18C, 18D, 18E, 18F:
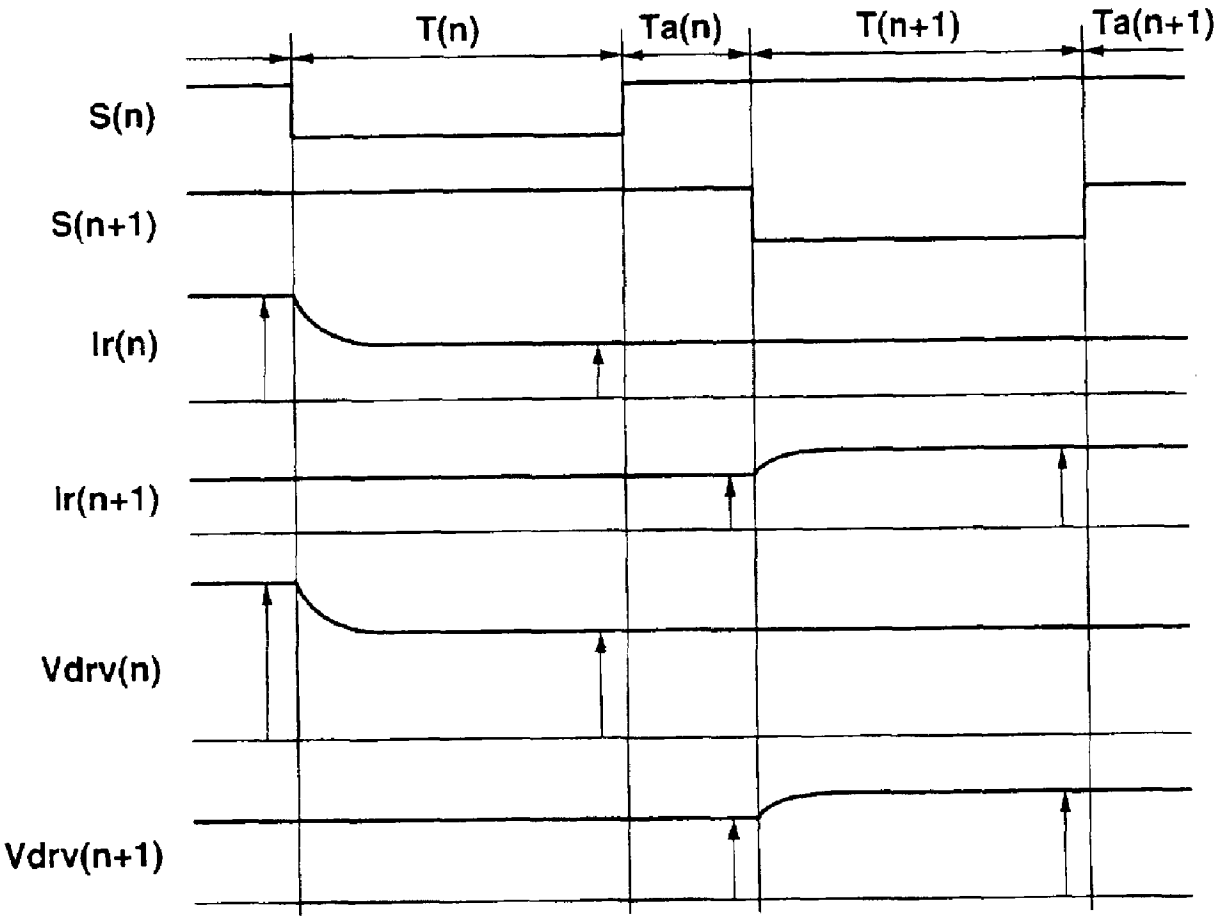
FIGS. 18A–18F are time charts, each illustrating an operation of the image display panel shown in FIG. 17.

FIG. 1 is a circuit diagram of a current supply circuit 1*l* included in a driving circuit for a light emitting element, according to a first embodiment of the present invention. FIG. 2 is a circuit diagram of a column-driving control circuit 2*v* included in the driving circuit for the light emitting element, according to the first embodiment. The display panel system shown in FIG. 17 is comprised of the current supply circuits 1*l* and the driving control circuits 2*v*.

(Configuration of the Current Supply Circuit 1*l*)

Referring now to FIG. 1, the source terminal $M3_S$ of a p-type transistor M3 is connected to a power supply VCC. The gate terminal $M3_G$ Of the p-type transistor M3 is connected to a capacitor C1. Another terminal of the capacitor C1 is connected to the power supply VCC. The drain terminal $M3_D$ of the p-type transistor M3 is connected to the source terminal $M4_S$ of a transistor M4. The drain terminal $M4_D$ of the transistor M4 is connected to an injection-current terminal of the light emitting element EL. Another terminal of the light emitting element EL is grounded. A control signal S3 is input to the gate terminal $M4_G$ of the transistor M4. The drain electrode $M1_D$ of a transistor M1 is connected to the gate terminal $M3_G$. An error current D is input to the source terminal $M1_S$ of the transistor M1. A control signal S1 is input to the gate terminal $M1_G$ of the transistor M1. The source terminal $M2_S$ of a transistor M2 is connected to the drain terminal $M3_D$. A signal SR is output to the drain terminal $M2_D$ of the transistor M2, and a control signal S2 is input to the gate terminal $M2_G$ of the transistor M2. Since the direction of the current flowing in the transistor M1 changes depending on the control of increasing or decreasing a gate-terminal voltage Vg of the transistor M3, the source and the drain of the transistor M1 are exchanged. In the first and following embodiments, however, a terminal connected to the gate terminal $M3_G$ is termed a drain.

(Configuration of the Column-Driving Control Circuit 2*v*)

Referring now to FIG. 2, the signal SR is input to the source terminal $M16_S$ of a transistor M16. A control signal S4 is input to the gate terminal $M16_G$ of the transistor M16. The drain terminal $M16_D$ of the transistor M16 is connected to a voltage-sample-and-hold circuit SH1, whose output is input to the gate terminal $M12_G$ of a transistor M12. The signal SR is also input to the source terminal $M17_S$ of a transistor M17. A control signal S5 is input to the gate terminal $M17_G$ of the transistor M17. The drain terminal $M17_D$ of the transistor M17 is connected to a voltage-sample-and-hold circuit SH2, whose output is input to the gate terminal $M9_G$ of a transistor M9. The voltage-sample-and-hold circuits SH1 and SH2 are controlled by sampling signals SP1 and SP2, respectively. A setting signal VB is input to the gate terminal $M10_G$ of a transistor M10. The source terminal $M10_S$ of the transistor M10 is connected to a power supply VEE, and the drain terminal $M10_D$ of the transistor M10 is connected to the source terminal $M9_S$ of a transistor M9 and the source terminal $M12_S$ of the transistor M12. A current 2Idrv whose value is twice the value of a setting current Idrv flows in the transistor M10. The drain terminal $M9_D$ of the transistor M9 is connected to a power supply VDD. The drain terminal $M12_D$ of the transistor M12 is connected to a transistor M11 whose drain and gate are short circuited. The gate terminal M11 of the transistor M11 is connected to the gate terminal $M13_G$ of a transistor M13 whose source is connected to the power supply VDD. The drain terminal $M13_D$ of the transistor M13 is connected to a transistor M14 whose drain and gate are connected. The source terminal $M14_S$ of the transistor M14 is connected to the power supply VEE. The gate terminal $M14_G$ of the transistor M14 is connected to the gate terminal $M15_G$ of a transistor M15 whose source is connected to the power supply VEE, and the drain terminal $M15_D$ of the transistor M15 is connected to the drain terminal $M16_D$ of a transistor M16. The gate terminal $M14_G$ is connected to the gate terminal $M8_G$ of a transistor M8 whose source is connected to the power supply VEE. The drain terminal $M8_D$ of the transistor M8 is connected to the drain terminal $M7_D$) of a transistor M7 whose drain and gate are connected, and the source terminal $M8_S$ of the transistor M8 is connected to the power supply VEE. The gate terminal $M7_G$ of the transistor M7 is connected to the gate terminal $M6_G$ of a transistor M6 whose source is connected to the power supply VDD. The drain terminal $M6_D$ of the transistor M6 is connected to the drain terminal $M5_D$ of a transistor M5 whose source is connected to the power supply VEE, and outputs an error current D. A setting signal VB is input to the gate terminal $M5_G$ of the transistor M5, and the setting current Idrv flows in the transistor M5.

(Configuration, and Description of the Operation of the Voltage-Sample-and-Hold Circuit)

Figure 3:
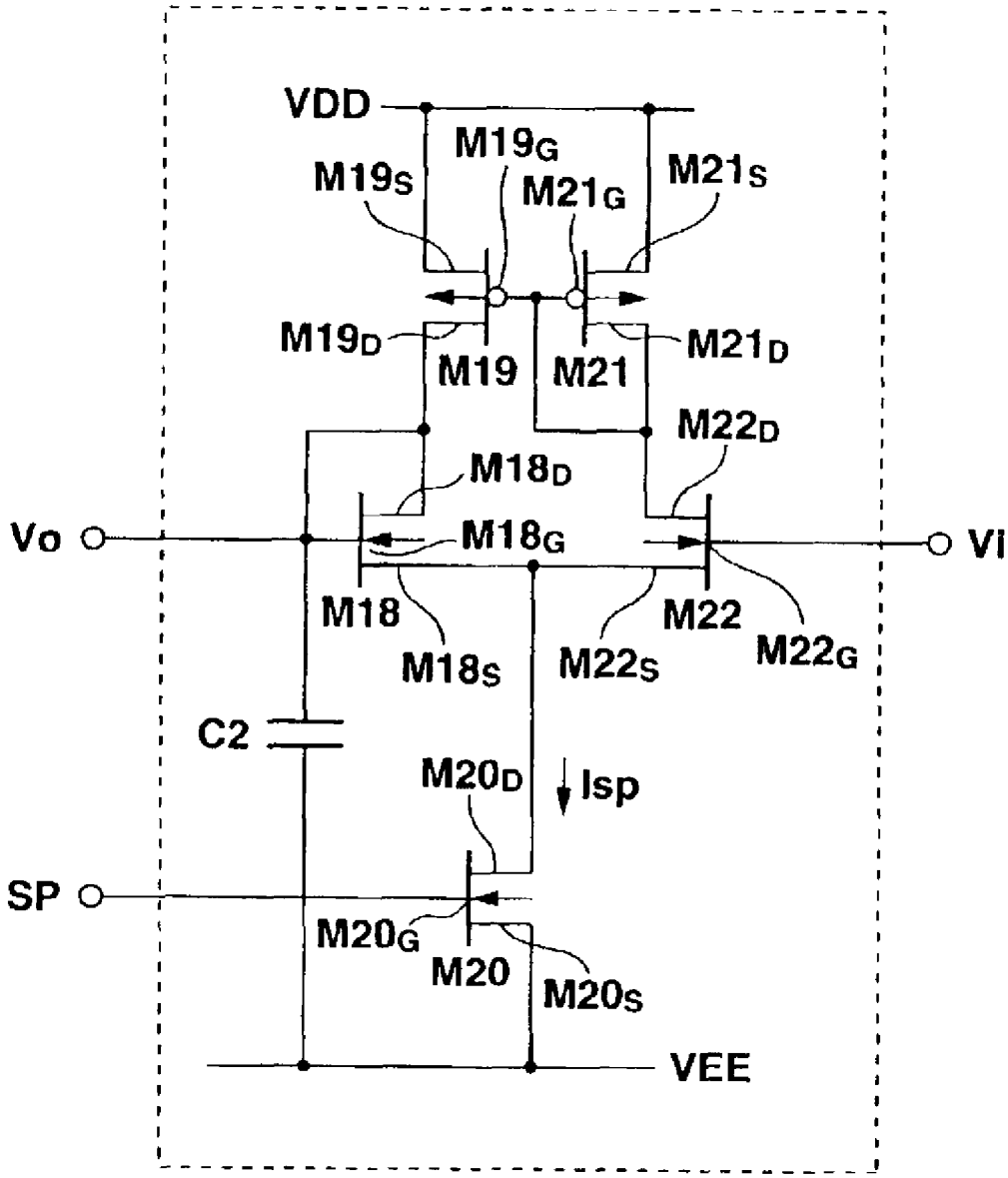
FIG. 3 is a circuit diagram illustrating a voltage sampling circuit according to the first embodiment.

FIG. 3 illustrates an example of the configuration of each of the voltage-sample-and-hold circuits SH1 and SH2. An input signal Vi is input to the gate terminal $M22_G$ of a transistor M22. The drain and the gate of the transistor M22 are short circuited, and the drain terminal $M22_D$ of the transistor M22 is connected to a transistor M21 whose source is connected to the power supply VDD. The gate terminal $M21_G$ of a transistor M21 is connected to the gate terminal $M19_G$ of a transistor M19. The source terminal M19S of the transistor M19 is connected to the power supply VDD, and the drain terminal $M19_D$ of the transistor M19 is connected to a transistor M18 whose drain and gate are short circuited. The source terminal $M18_S$ of a transistor M18 and the source terminal $M22_S$ of the transistor M22 are short circuited, and are connected to the drain terminal $M20_D$ of a transistor M20. The source terminal $M20_S$ of the transistor M20 is connected to the power supply VEE that is an internal GND of the column-driving control circuit provided in the form of an LSI (large scale integrated circuit) (not shown). A sampling control signal SP is input to the gate terminal $M20_G$ of the transistor M20. The signal SP causes a sampling current Isp to flow in the transistor M20 at an H level. The transistor M20 assumes an off-state when the signal SP assumes an L level. A capacitor C2 that is connected to the power supply VEE is connected to the gate terminal $M18_G$ of the transistor M18, which outputs an output signal Vo. While the signal SP is at the H level, the circuit shown in FIG. 3 operates as a voltage buffer, and the capacitor C2 is charged until Vo=Vi. When the signal SP assumes the L level, the current supply source for the transistor M18 disappears, and the voltage Vo generated when the signal SP was at the H level is maintained, to complete a voltage sampling operation.

(Explanation of the Operation)

Figure 4:
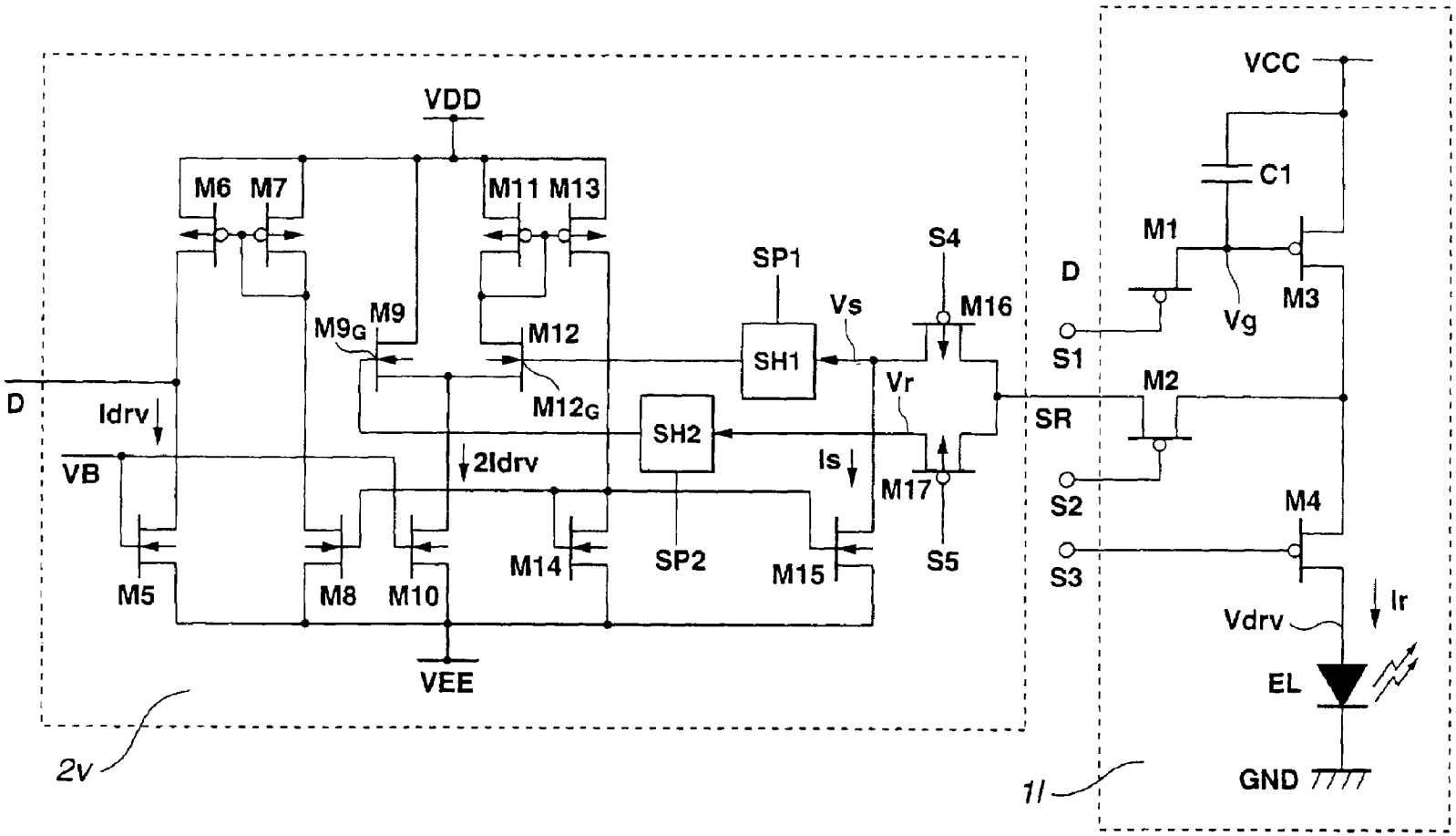
FIG. 4 is a circuit diagram illustrating an emission continuation operation of the driving circuit for the light emitting element according to the first embodiment.
Figure 5:
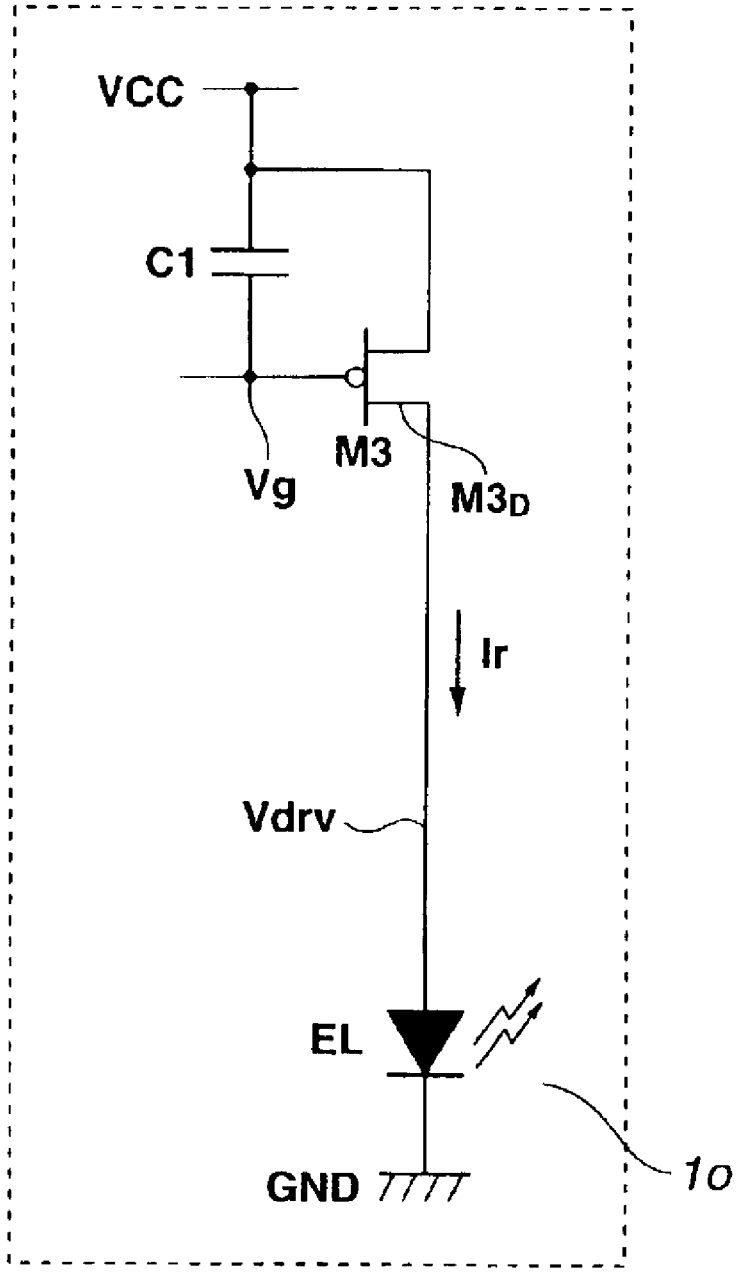
FIG. 5 is an operational circuit diagram illustrating an emission continuation operation of the current supply circuit included in the driving circuit for the light emitting element according to the first embodiment.

FIG. 4 is a circuit diagram illustrating the light-emission continuation operation of the driving circuit for the light emitting element of the first embodiment. FIG. 5 is a circuit diagram illustrating the light-emission continuation operation of the current supply circuit included in the driving circuit for the light emitting element of the first embodiment. FIGS. 6A–6H are time charts, each illustrating an operation of the driving circuit for the light emitting element of the first embodiment.

A description will now be provided of the operation of control of light emission of the light emitting element performed by the column driving control circuit 2*v* for the corresponding row and the current supply circuit 1*l* for the corresponding pixel.

<Premise>

In order to facilitate explanation, it is assumed that the size ratio proportional to the ratio between the current driving characteristics of respective transistors is set such that M10=2×M5=2×M15, M6=M7, M9=M12, and M11=M13, and that the on-resistance of each of the transistors M1, M2, M4, M16 and M17 is sufficiently low when the gate voltage of the transistor assumes the L level.

(1) Before the control period T(n) for the n-th row,

S1(*n*)=H→M1=OFF

S2(*n*)=H→M2=OFF

S3(*n*)=L→M4=ON

S4(*n*)=H→M16=OFF

S5(*n*)=H→M17=OFF

SP1(*n*)=L→SH1: holding mode

SP2(*n*)=L→SH2: holding mode

At that time, the connection of the column-driving control circuit 2*v* with the corresponding current supply circuit 1*l* disappears, and the current supply circuit 1*l* is in the state shown in FIG. 5. That is, predetermined light emission is performed by the gate-terminal voltage Vg set for injecting an injection current Ir that determines the amount of light emission of the light-emitting element set at the immediately preceding period (the immediately preceding frame period).

(2) During the period Ts(n),

S1(*n*)=H→M1=OFF

S2(*n*)=L→M2=ON

S3(*n*)=L→M4=ON

S4(*n*)=H→M16=OFF

S5(*n*)=H→M17=OFF

SP1(*n*)=L→SH1: holding mode

SP2(*n*)=L→SH2: holding mode

Figures 6A, 6B, 6C, 6D, 6E, 6F, 6G, 6H:
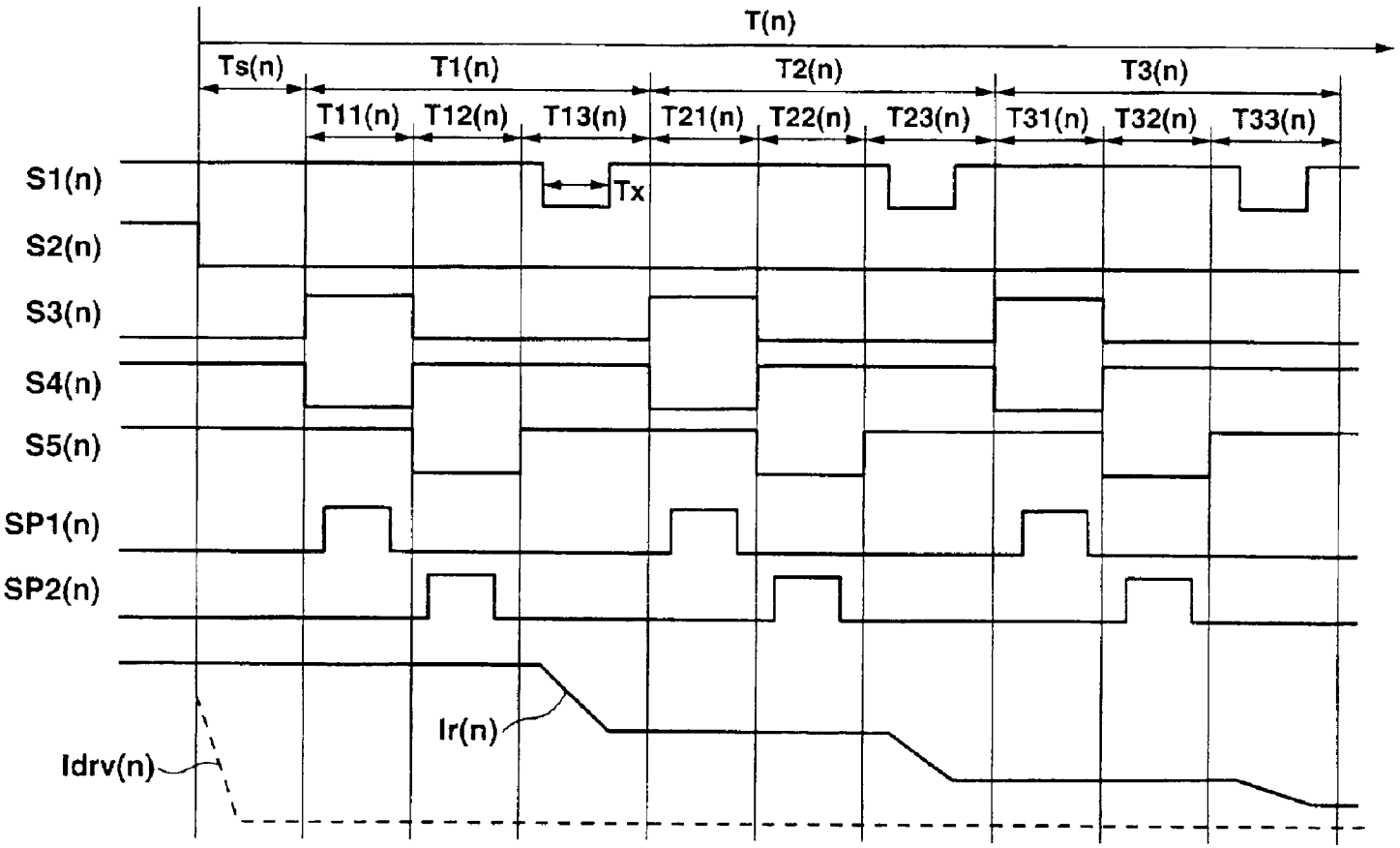
FIGS. 6A–6H are time charts, each illustrating an operation of the driving circuit for the light emitting element according to the first embodiment.

At that time, the drain terminal $M3_D$ is connected to the column-driving control circuit 2*v*, and resetting of the set current Idrv(n) is performed by the setting signal VB. In the case of FIG. 6H, the setting current Idrv is set to a reduced value.

(3) During the period T11(*n*),

S1(*n*)=H→M1=OFF

S2(*n*)=L→M2=ON

S3(*n*)=H→M4=OFF

S4(*n*)=L→M16=ON

S5(*n*)=H→M17=OFF

SP1(*n*)=H→SH1: sampling mode

SP2(*n*)=L→SH2: holding mode

The following assumption is performed.

<Assumption>

It is assumed that both of the SH1 output ($M12_G$) and the SH2 output ($M9_G$) are held to the operational voltage Vdrv of the light emitting element operating by the previously set injection current.

At that time, the current flowing in the transistor M3 is the previously set current, and the voltage Vs increases during this period in which the setting current Idrv is reduced. As a result, the gate terminal $M12_G$ is also held at an increased voltage. Accordingly, the error current D of the column-driving control circuit 2*v* is an up current.

(4) During the period T12(*n*),

S1(*n*)=H→M1=OFF

S2(*n*)=L→M2=ON

S3(*n*)=L→M4=ON

S4(*n*)=H→M16=OFF

S5(*n*)=L→M17=ON

SP1(*n*)=L→SH1: holding mode

SP2(*n*)=H→SH2: sampling mode

At that time, the current of the transistor M3 is injected into the light-emitting element, and the operational voltage Vdrv at that time is input to the gate terminal $M9_G$ by the SH2. However, since the current of the transistor M3 equals the immediately preceding injection current Ir, the voltage of the gate terminal $M9_G$ equals the previously held voltage. Accordingly, the error current D of the column-driving control circuit 2*v* is an up current.

(5) During the period T13(*n*),

S1(*n*)=L→M1=ON

S2(*n*)=L→M2=ON

S3(*n*)=L→M4=ON

S4(*n*)=H→M16=OFF

S5(*n*)=H→M17=OFF

SP1(*n*)=L→SH1: holding mode

SP2(*n*)=L→SH2: holding mode

At that time, the error current D of the column-driving control circuit 2*v* continues to be an up current, and is supplied to the gate terminal $M3_G$ of the current supply circuit 1*l*, to increase the voltage of this terminal and reduce the current Ir(n) (see FIG. 6H).

(6) During the period T21(*n*),

S1(*n*)=H→M1=OFF

S2(*n*)=L→M2=ON

S3(*n*)=H→M4=OFF

S4(*n*)=L→M16=ON

S5(*n*)=H→M17=OFF

SP1(*n*)=H→SH1: sampling mode

SP2(*n*)=L→SH2: holding mode

At that time, since the current Ir(n) flowing in the transistor M3 is smaller than the current during the period T11(*n*), the voltage Vs is smaller than during the period T11(*n*). Hence, the voltage of the gate terminal $M12_G$ is also held to a value smaller than during the period T11(*n*). Accordingly, although the error current D of the column-driving control circuit 2*v* remains to be an up current, the current value is smaller than during the period T11(*n*).

(7) During the period T22(*n*),

S1(*n*)=H→M1=OFF

S2(*n*)=L→M2=ON

S3(*n*)=L→M4=ON

S4(*n*)=H→M16=OFF

S5(*n*)=L→M17=ON

SP1(*n*)=L→SH1: holding mode

SP2(*n*)=H→SH2: sampling mode

At that time, the current of the transistor M3 is injected into the light emitting element, and the operational voltage Vdrv at that time is input to the gate terminal $M9_G$ by the SH2. However, since the current of the transistor M3 is smaller than during the period T12(*n*), the voltage applied to the transistor M3 increases from the voltage held during the period T12(*n*). Accordingly, although the error current D of the column-driving control circuit 2*v* remains to be an up current, the current value is smaller than during the period T12(*n*).

(8) During the period T23(*n*),

S1(*n*)=L→M1=ON

S2(*n*)=L→M2=ON

S3(*n*)=L→M4=ON

S4(*n*)=H→M16=OFF

S5(*n*)=H→M17=OFF

SP1(*n*)=L→SH1: holding mode

SP2(*n*)=L→SH2: holding mode

At that time, the error current D of the column-driving control circuit 2*v* continues to be an up current, and is supplied to the gate terminal $M3_G$ of the current supply circuit 1*l*, to increase the voltage of this terminal and reduce the current Ir(n) (see FIG. 6H). However, since the value of the up current is smaller than during the period T13(*n*), the speed of decrease of the current Ir(n) is smaller than during the period T13(*n*) (see FIG. 6H).

(9) During each of the periods T31(*n*), T32(*n*) and T33(*n*), a similar operation is repeated. The injection current Ir(n) into the light emitting element gradually approaches the setting current Idrv and finally equals the setting current Idrv by further repeating the above-described sequence. Although the frequency of repetition operations may be as large as possible within an allowable range of the system, it is not limited to a certain number. At that time, the voltage Vs equals the voltage Vr. These are conditions with which the above-described assumption holds, and indicate that the foregoing explanation logically holds.

(10) In the succeeding process,

S1(*n*)=H→M1=OFF

S2(*n*)=H→M2=OFF

S3(*n*)=L→M4=ON

S4(*n*)=H→M16=OFF

S5(*n*)=H→M17=OFF

SP1(*n*)=L→SH1: holding mode

SP2(*n*)=L→SH2: holding mode

At that time, since the column-driving control circuit 2*v* is not connected to the current supply circuit for the n-th row, the corresponding current supply circuit 1*l* has the circuit configuration shown in FIG. 5. The current Ir flowing in the transistor M3 continues to be the injection current Ir(n) equal to the setting current Idrv(n), and the light emitting element continues to perform desired light emission.

Basically, the above-described operation of setting the injection current Ir to the setting current and the light emission operation of the light emitting element by the set injection current Ir are not influenced by the transistor characteristics of the current supply circuit 1*l*. That is, since the driving control circuit side determines the gate-terminal voltage Vg by the reference current Is actually flowing in the transistor M3, these operations are not influenced by variations among the characteristics of light emitting elements. Furthermore, by adding the condition that the drain-terminal voltage of the transistor M3, serving as the supply transistor, is equal when inputting information for determining the gate-terminal voltage Vg by the reference current Is at the driving control circuit side, and when the injection current Ir flows in the light emitting element, it is possible to exactly control the Ir by the Idrv without being influenced by the Early effect due to variations in the source-drain voltage of the transistor M3. It is thereby possible to stably control the Ir even if the operational voltage Vdrv changes due to degradation with time of the light emitting element, when using an organic EL element as the light emitting element. It is also possible to set the potential of the power supply VCC with a small margin.

It is apparent that the transistors M1, M2 and M3 of the current supply circuit 1*l* may be replaced by any other circuit configurations that perform a switching operation by inputting appropriate control signals S1, S2 and S3, and that the p-type transistor M3 may be replaced by an n-type transistor by modifying connection to the light emitting element and the configuration of the column-driving control circuit 2*v*. Furthermore, the capacitor C1 may be realized by a parasitic capacitance of connected transistors.

[Second Embodiment]

Figure 7:
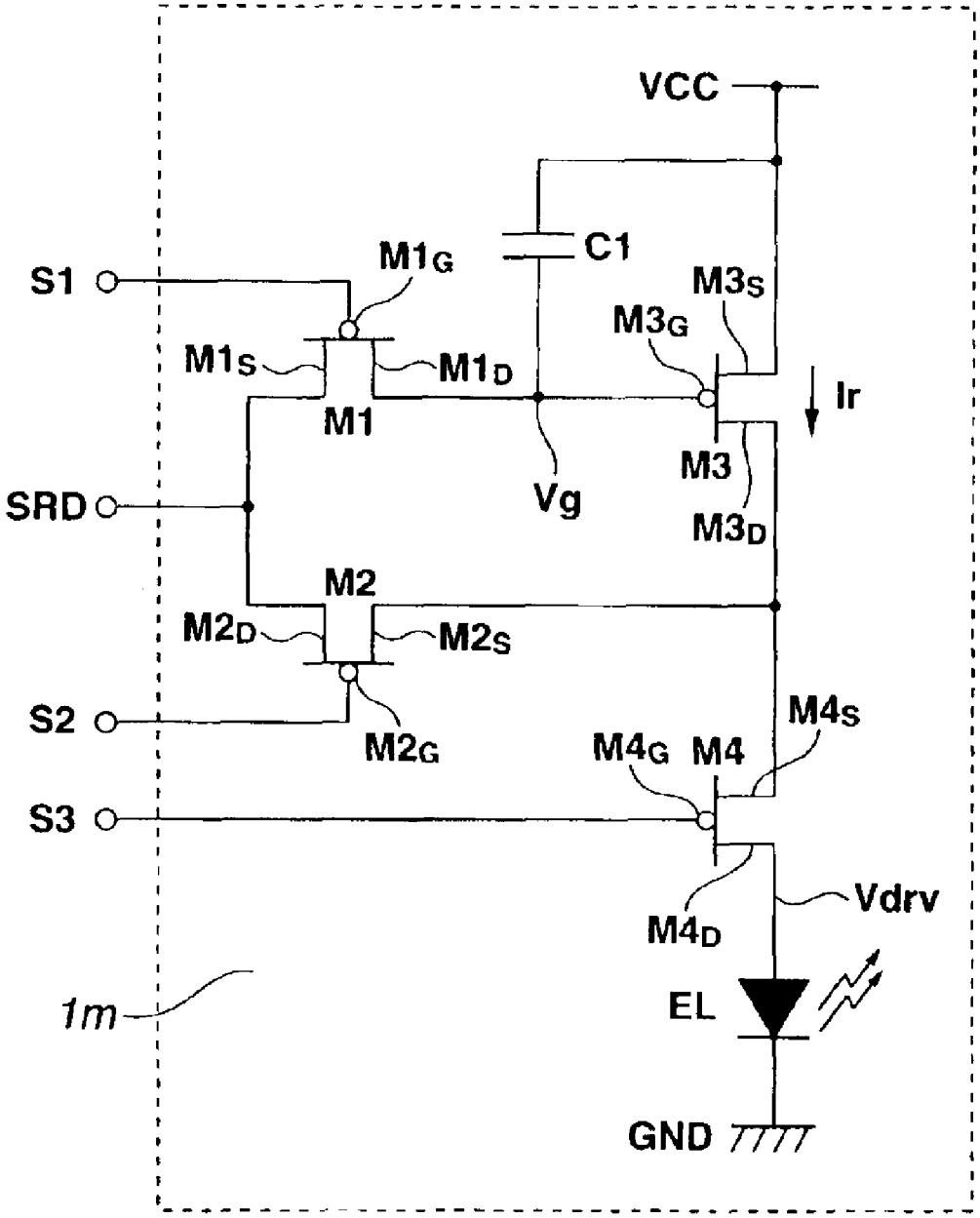
FIG. 7 is a circuit diagram of a current supply circuit included in a driving circuit for a light emitting element according to a second embodiment of the present invention.
Figure 8:
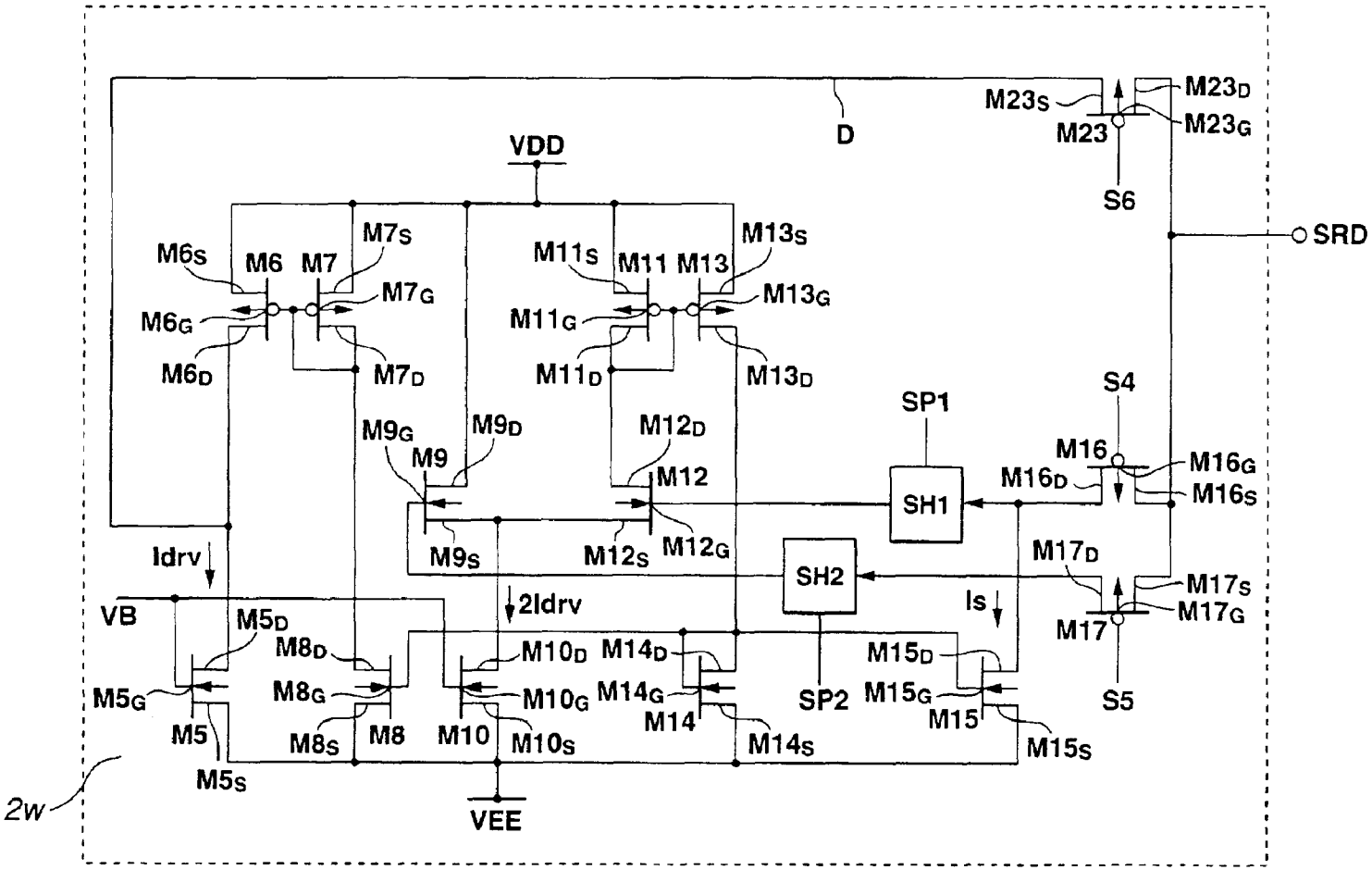
FIG. 8 is a circuit diagram of a driving control circuit included in the driving circuit for the light emitting element according to the second embodiment.

FIG. 7 is a circuit diagram of a current supply circuit 1*m* included in a driving circuit for a light emitting element, according to a second embodiment of the present invention. FIG. 8 is a circuit diagram of a column-driving control circuit 2*w* included in the driving circuit for the light emitting element, according to the second embodiment. The display panel system shown in FIG. 17 is comprised of the current supply circuits 1*m* and the column-driving control circuits 2*w*.

(Configuration of the Current Supply Circuit 1*m*)

Referring now to FIG. 7, the source terminal $M3_S$ of a p-type transistor M3 is connected to a power supply VCC. The gate terminal $M3_G$ of the p-type transistor M3 is connected to a capacitor C1. Another terminal of the capacitor C1 is connected to the power supply VCC. The drain terminal $M3_D$ of the p-type transistor M3 is connected to the source terminal $M4_S$ of a transistor M4. The drain terminal $M4_D$ of the transistor M4 is connected to an injection-current terminal of the light emitting element EL. Another terminal of the light emitting element EL is grounded. A control signal S3 is input to the gate terminal $M4_G$ of the transistor M4. The drain electrode $M1_D$ of a transistor M1 is connected to the gate terminal $M3_G$. A control signal S1 is input to the gate terminal $M1_G$ of the transistor M1. The source terminal $M2_S$ of a transistor M2 is connected to the drain terminal $M3_D$. A control signal S2 is input to the gate terminal $M2_G$ of the transistor M2. The source terminal $M1_S$ of the transistor M1 and the drain terminal $M2_D$ of a transistor M2 are short circuited, and a signal SRD is input thereto.

(Configuration of the Column-Driving Control Circuit 2*w*)

The signal SRD is input to the source terminal $M16_S$ of a transistor M16. A control signal S4 is input to the gate terminal $M16_G$ of a transistor M16. The drain terminal $M16_D$ of the transistor M16 is connected to a voltage-sample-and-hold circuit SH1, whose output is input to the gate terminal $M12_G$ of a transistor M12. The signal SRD is also input to the source terminal $M17_S$ of a transistor M17. A control signal S5 is input to the gate terminal $M17_6$ of the transistor M17. The drain terminal $M17_D$ of the transistor M17 is connected to a voltage-sample-and-hold circuit SH2, whose output is input to the gate terminal $M9_G$ of a transistor M9. The voltage-sample-and-hold circuits SH1 and SH2 are controlled by sampling signals SP1 and SP2, respectively. A setting signal VB is input to the gate terminal $M10_G$ of a transistor M10. The source terminal $M10_S$ of the transistor M10 is connected to a power supply VEE, and the drain terminal $M10_D$ of the transistor M10 is connected to the source terminal $M9_S$ of a transistor M9 and the source terminal $M12_S$ of the transistor M12. A current 2Idrv whose value is twice the value of a setting current Idrv flows in the transistor M10. The drain terminal $M9_D$ of the transistor M9 is connected to a power supply VDD. The drain terminal $M12_D$ of the transistor M12 is connected to a transistor M11 whose drain and gate are short circuited. The gate terminal $M11_G$ of the transistor M1 is connected to the gate terminal $M13_G$ of a transistor M13 whose source is connected to the power supply VDD. The drain terminal $M13_D$ of the transistor M13 is connected to a transistor M14 whose drain and gate are connected. The source terminal $M14_S$ of the transistor M14 is connected to a power supply VEE. The gate terminal $M14_G$ of the transistor M14 is connected to the gate terminal $M15_G$ of a transistor M15 whose source is connected to the power supply VEE, and the drain terminal $M15_D$ of the transistor M15 is connected to the drain terminal $M16_D$ of a transistor M16. The gate terminal $M14_G$ is connected to the gate terminal $M8_G$ of a transistor M8 whose source is connected to the power supply VEE. The drain terminal $M8_D$ of the transistor M8 is connected to the drain terminal $M7_D$ of a transistor M7 whose drain and gate are connected, and the source terminal $M8_S$ of the transistor M8 is connected to the power supply VEE. The gate terminal $M7_G$ of the transistor M7 is connected to the gate terminal $M6_G$ of a transistor M6 whose source is connected to the power supply VDD. The drain terminal $M6_D$ of the transistor M6 is connected to the drain terminal $M5_D$ of a transistor M5 whose source is connected to the power supply VEE, and outputs an error current D. A setting signal VB is input to the gate terminal $M5_G$ of the transistor M5, and a setting current Idrv flows in the transistor M5. The error current D is input to the source terminal $M23_S$ of a transistor M23. A control signal S67 is input to the gate terminal $M23_G$ of the transistor M23. The drain terminal $M23_D$ of the transistor M23 is connected to the source terminal $M16_S$ of a transistor M16 and the source terminal $M17_S$ of a transistor M17.

The same circuit as that described in the first embodiment is used as the voltage-sample-and-hold circuit. Therefore, further explanation of the circuit is omitted.

(Explanation of the Operation)

Figure 9:
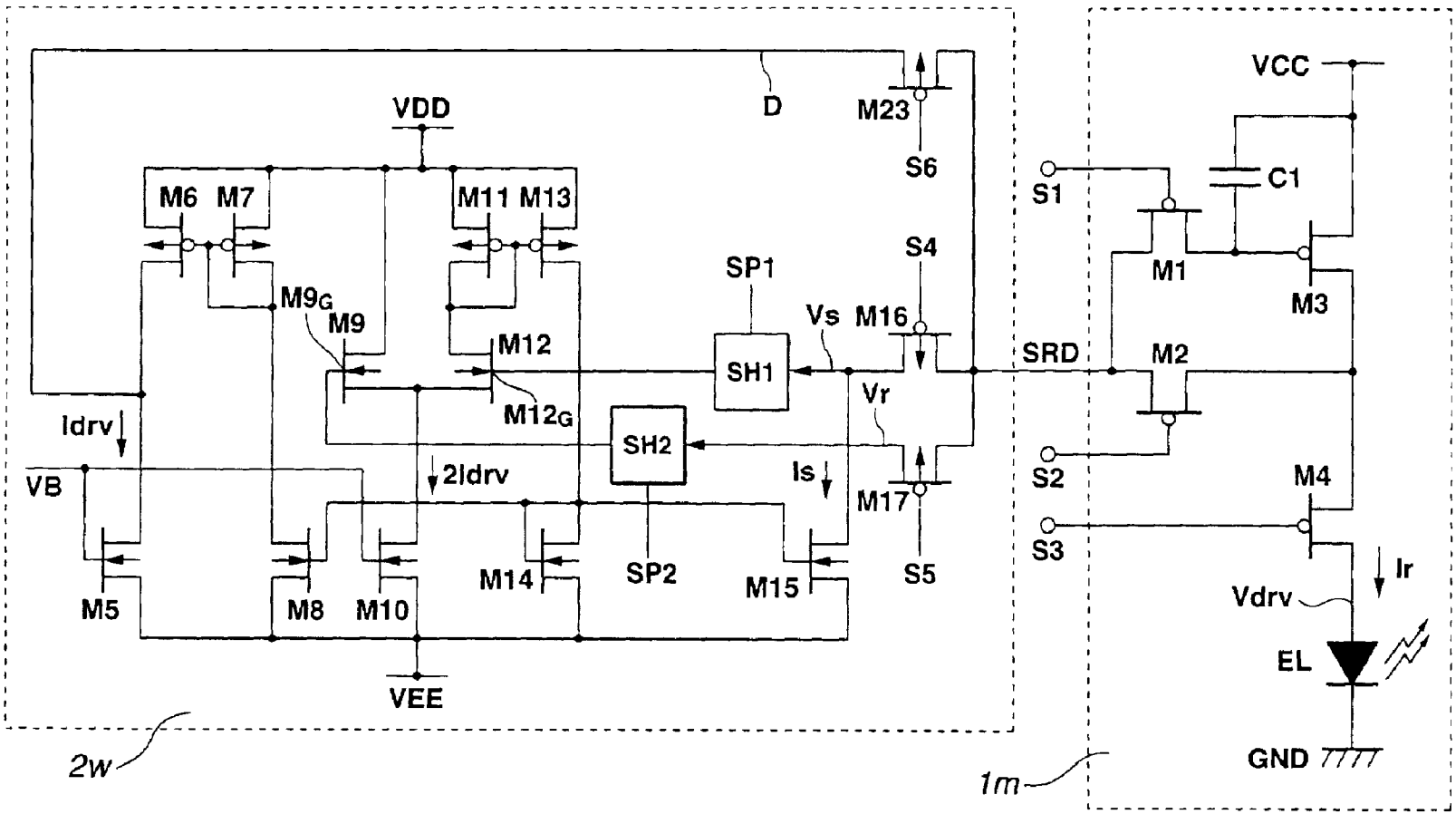
FIG. 9 is a circuit diagram illustrating an emission continuation operation of the driving circuit for the light emitting element according to the second embodiment.

FIG. 9 is a circuit diagram illustrating the light-emission continuation operation of the driving circuit for the light emitting element of the second embodiment. FIGS. 10A–10I are time charts, each illustrating an operation of the driving circuit for the light emitting element of the second embodiment.

A description will now be provided of the operation of control of light emission of the light emitting element performed by the column-driving control circuit 2*w* for the corresponding row and the current supply circuit 1*m* for the corresponding pixel.

<Premise>

In order to facilitate explanation, it is assumed that the size ratio proportional to the ratio between the current driving characteristics of respective transistors is set such that M10=2×M5=2×M15, M6=M7, M9=M12, and M11=M13, and that the on-resistance of each of the transistors M1, M2, M4, M16 and M17 is sufficiently low when the gate voltage of the transistor assumes the L level.

(1) Before the control period T(n) for the n-th row,

S1(*n*)=H→M1=OFF

S2(*n*)=H→M2=OFF

S3(*n*)=L→M4=ON

S4(*n*)=H→M16=OFF

S5(*n*)=H→M17=OFF

S6(*n*)=H→M23=OFF

SP1(*n*)=L→SH1: holding mode

SP2(*n*)=L→SH2: holding mode

At that time, the connection of the column-driving control circuit 2*w* with the corresponding current supply circuit 1*m* disappears, and the current supply circuit 1*m* is in the state shown in FIG. 5. That is, predetermined light emission is performed by the gate-terminal voltage Vg set for injecting an injection current Ir that determines the amount of light emission of the light emitting element set at the immediately preceding period (the immediately preceding frame period).

(2) During the period Ts(n),

S1(*n*)=H→M1=OFF

S2(*n*)=H→M2=OFF

S3(*n*)=L→M4=ON

S4(*n*)=H→M16=OFF

S5(*n*)=H→M17=OFF

S6(*n*)=H→M23=OFF

SP1(*n*)=L→SH1: holding mode

SP2(*n*)=L→SH2: holding mode

Figures 10A, 10B, 10C, 10D, 10E, 10F, 10G, 10H, 10I:
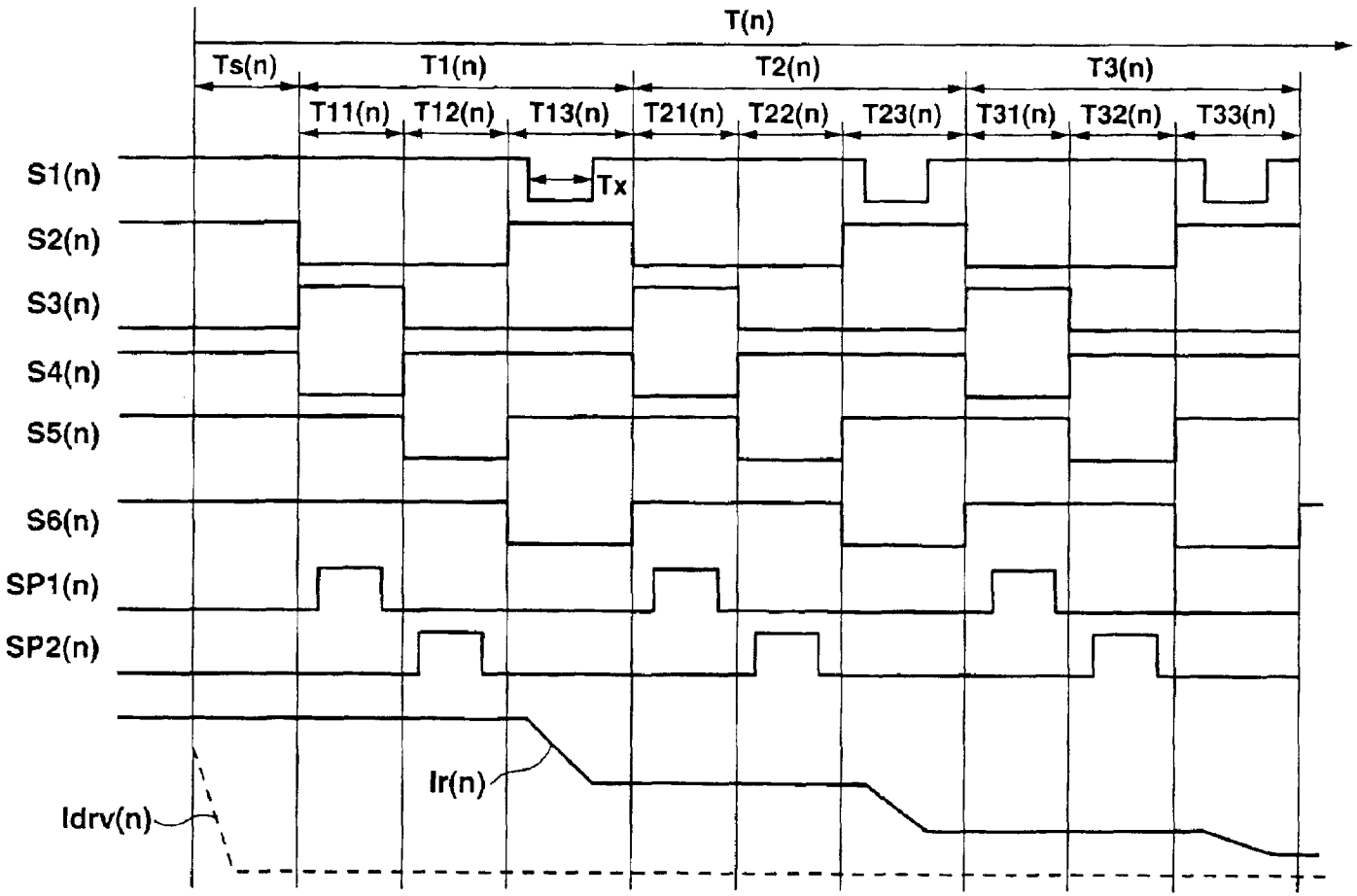
FIGS. 10A–10I are time charts, each illustrating an operation of the driving circuit for the light emitting element according to the second embodiment.

At that time, resetting of the set current Idrv(n) is performed by the setting signal VB. In the case of FIG. 10I, the setting current Idrv is set to a reduced value.

(3) During the period T11(*n*),

S1(*n*)=H→M1=OFF

S2(*n*)=L→M2=ON

S3(*n*)=H→M4=OFF

S4(*n*)=L→M16=ON

S5(*n*)=H→M17=OFF

S6(*n*)=H→M23=OFF

SP1(*n*)=H→SH1: sampling mode

SP2(*n*)=L→SH2: holding mode

The following assumption is performed.

<Assumption>

It is assumed that both of the SH1 output ($M12_G$) and the SH2 output ($M9_G$) are held to the operational voltage Vdrv of the light emitting element operating by the previously set injection current.

At that time, the current flowing in the transistor M3 is the previously set current, and the voltage Vs increases during this period in which the setting current Idrv is reduced. As a result, the gate terminal $M12_G$ is also held at an increased voltage. Accordingly, the error current D of the row-driving control circuit 2*w* is an up current.

(4) During the period T12(*n*),

S1(*n*)=H→M1=OFF

S2(*n*)=L→M2=ON

S3(*n*)=L→M4=ON

S4(*n*)=H→M16=OFF

S5(*n*)=L→M17=ON

S6(*n*)=H→M23=OFF

SP1(*n*)=L→SH1: holding mode

SP2(*n*)=H→SH2: sampling mode

At that time, the current of the transistor M3 is injected into the light emitting element, and the operational voltage Vdrv at that time is input to the gate terminal $M9_G$ by the SH2. However, since the current of the transistor M3 equals the immediately preceding injection current Ir, the voltage applied to the gate terminal $M9_G$ equals the previously held voltage. Accordingly, the error current D of the row-driving control circuit 2*w* is an up current.

(5) During the period T13(*n*),

S1(*n*)=L→M1=ON

S2(*n*)=H→M2=OFF

S3(*n*)=L→M4=ON

S4(*n*)=H→M16=OFF

S5(*n*)=H→M17=OFF

S6(*n*)=L→M23=ON

SP1(*n*)=L→SH1: holding mode

SP2(*n*)=L→SH2: holding mode

At that time, the error current D of the column-driving control circuit 2*w* continues to be an up current, and is supplied to the gate terminal $M3_G$ of the current supply circuit 1*m*, to increase the voltage of this terminal and reduce the current Ir(n) (see FIG. 10I).

(6) During the period T21(*n*),

S1(*n*)=H→M1=OFF

S2(*n*)=L→M2=ON

S3(*n*)=H→M4=OFF

S4(*n*)=L→M16=ON

S5(*n*)=H→M17=OFF

S6(*n*)=H→M23=OFF

SP1(*n*)=H→SH1: sampling mode

SP2(*n*)=L→SH2: holding mode

At that time, since the current Ir(n) flowing in the transistor M3 is smaller than the current during the period T11(*n*), the voltage Vs is smaller than during the period T11(*n*). Hence, the voltage of the gate terminal $M12_G$ is also held to a value smaller than during the period T11(*n*). Accordingly, although the error current D of the column-driving control circuit 2*w* remains to be an up current, the current value is smaller than during the period T11(*n*).

(7) During the period T22(*n*),

S1(*n*)=H→M1=OFF

S2(*n*)=L→M2=ON

S3(*n*)=L→M4=ON

S4(*n*)=H→M16=OFF

S5(*n*)=L→M17=ON

S6(*n*)=H→M23=OFF

SP1(*n*)=L→SH1: holding mode

SP2(*n*)=H→SH2: sampling mode

At that time, the current of the transistor M3 is injected into the light emitting element, and the operational voltage Vdrv at that time is input to the gate terminal $M9_G$ by the SH2. However, since the current of the transistor M3 is smaller than during the period T12(*n*), the voltage applied to the transistor M3 increases from the voltage held during the period T12(*n*). Accordingly, although the error current D of the column-driving control circuit 2*w* remains to be an up current, the current value is smaller than during the period T12(*n*).

(8) During the period T23(*n*),

S1(*n*)=L→M1=ON

S2(*n*)=H→M2=OFF

S3(*n*)=L→M4=ON

S4(*n*)=H→M16=OFF

S5(*n*)=H→M17=OFF

S6($n$)=L→M23=ON

SP1($n$)=L→SH1: holding mode

SP2($n$)=L→SH2: holding mode

At that time, the error current D of the column-driving control circuit 2$w$ continues to be an up current, and is supplied to the gate terminal $M3_G$ of the current supply circuit 1$m$, to increase the voltage of this terminal and reduce the current Ir(n) (see FIG. 10I). However, since the value of the up current is smaller than during the period T13($n$), the speed of decrease of the current Ir(n) is smaller than during the period T13($n$) (see FIG. 10I).

(9) During each of the periods T31($n$), T32($n$) and T33($n$), a similar operation is repeated. The injection current Ir(n) into the light-emitting element gradually approaches the setting current Idrv and finally equals the setting current Idrv by further repeating the above-described sequence. Although the frequency of repetition operations may be as large as possible within an allowable range of the system, it is not limited to a certain number. At that time, the voltage Vs equals the voltage Vr. These are conditions with which the above-described assumption holds, and indicate that the foregoing explanation logically holds.

(10) In the succeeding process,

S1($n$)=H→M1=OFF

S2($n$)=H→M2=OFF

S3($n$)=L→M4=ON

S4($n$)=H→M16=OFF

S5($n$)=H→M17=OFF

S6($n$)=H→M23=OFF

SP1($n$)=L→SH1: holding mode

SP2($n$)=L→SH2: holding mode

At that time, since the column-driving control circuit 2$w$ is not connected to the current supply circuit for the n-th row, the corresponding current supply circuit 1$m$ has the circuit configuration shown in FIG. 5. The current Ir flowing in the transistor M3 continues to be the injection current Ir(n) equal to the setting current Idrv(n), and the light emitting element continues to perform desired light emission.

The above-described operation of setting the injection current Ir to the setting current and the light emission operation of the light emitting element by the set injection current Ir are not influenced by the transistor characteristics of the current supply circuit 1$m$, as in the first embodiment.

In addition to the effects of the first embodiment, according to the second embodiment, it is possible to reduce the number of wires that connect the current supply circuits and the driving control circuits. Accordingly, a great effect can be provided when, for example, applying the second embodiment to a display having a large number of pixels.

The transistors M1, M2 and M3 of the current supply circuit 1$m$ may be replaced by any other circuit configurations that perform a switching operation by inputting appropriate control signals S1, S2 and S3, and that the p-type transistor M3 may be replaced by an n-type transistor by modifying connection to the light-emitting element and the configuration of the column-driving control circuit 2$w$. Furthermore, the capacitor C1 may be realized by a parasitic capacitance of connected transistors.

Figure 19:
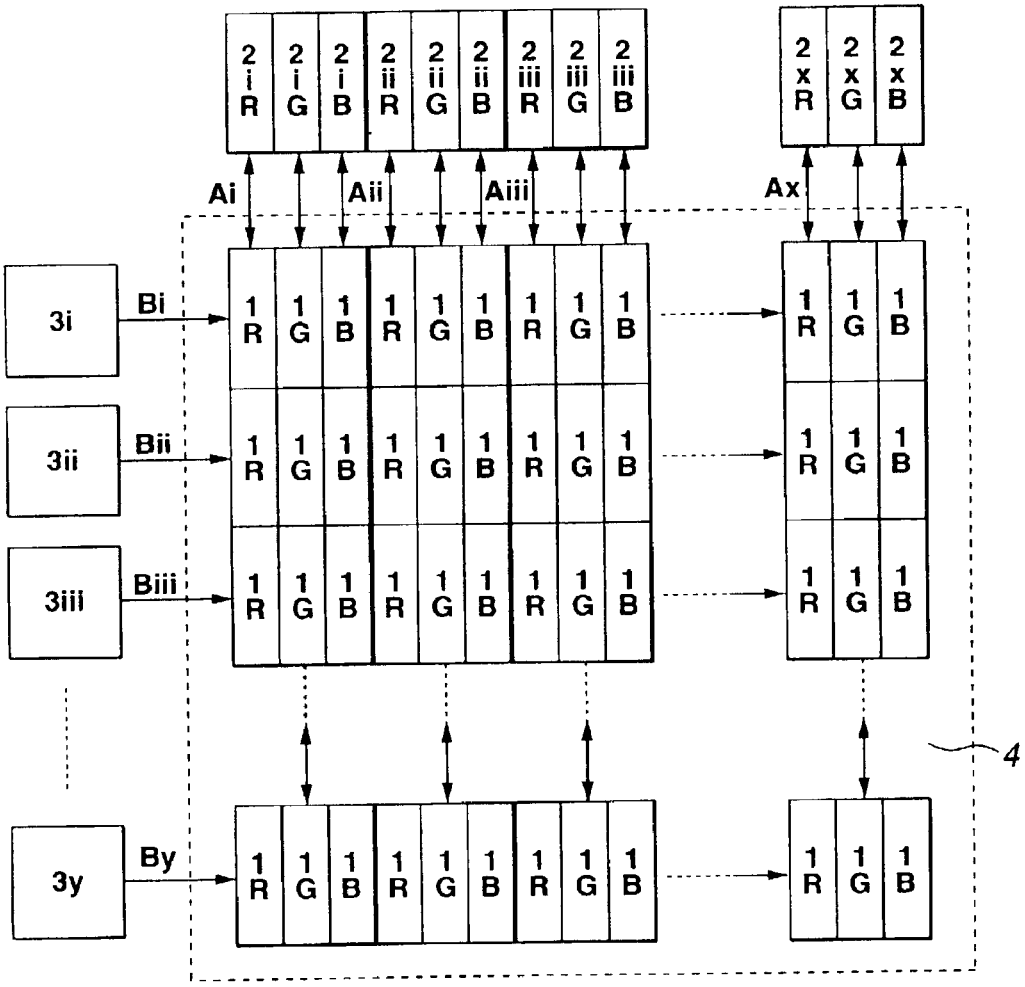
FIG. 19 is a schematic diagram illustrating a color image display panel.

When the image display unit 4 is arranged to display a color image, then, as shown in FIG. 19, each current supply circuit for one pixel is divided into a current supply circuit 1R for a red pixel, a current supply circuit 1G for a green pixel, and a current supply circuit 1B for a blue pixel. Accordingly, the number of signal lines for column control signals Ai–Ax is three times the number of signal lines in the monochromatic image display panel shown in FIG. 17. In consideration of wire layout on the display panel, it is desirable to minimize the number of signal lines for the column control signals Ai–Ax that are connected to the respective current supply circuits 1$m$. The configuration of the second embodiment is very convenient because only one signal line connecting the column-driving control circuit 2$w$ to the current supply circuit 1$m$ is required.

[Third Embodiment]

Figure 11:
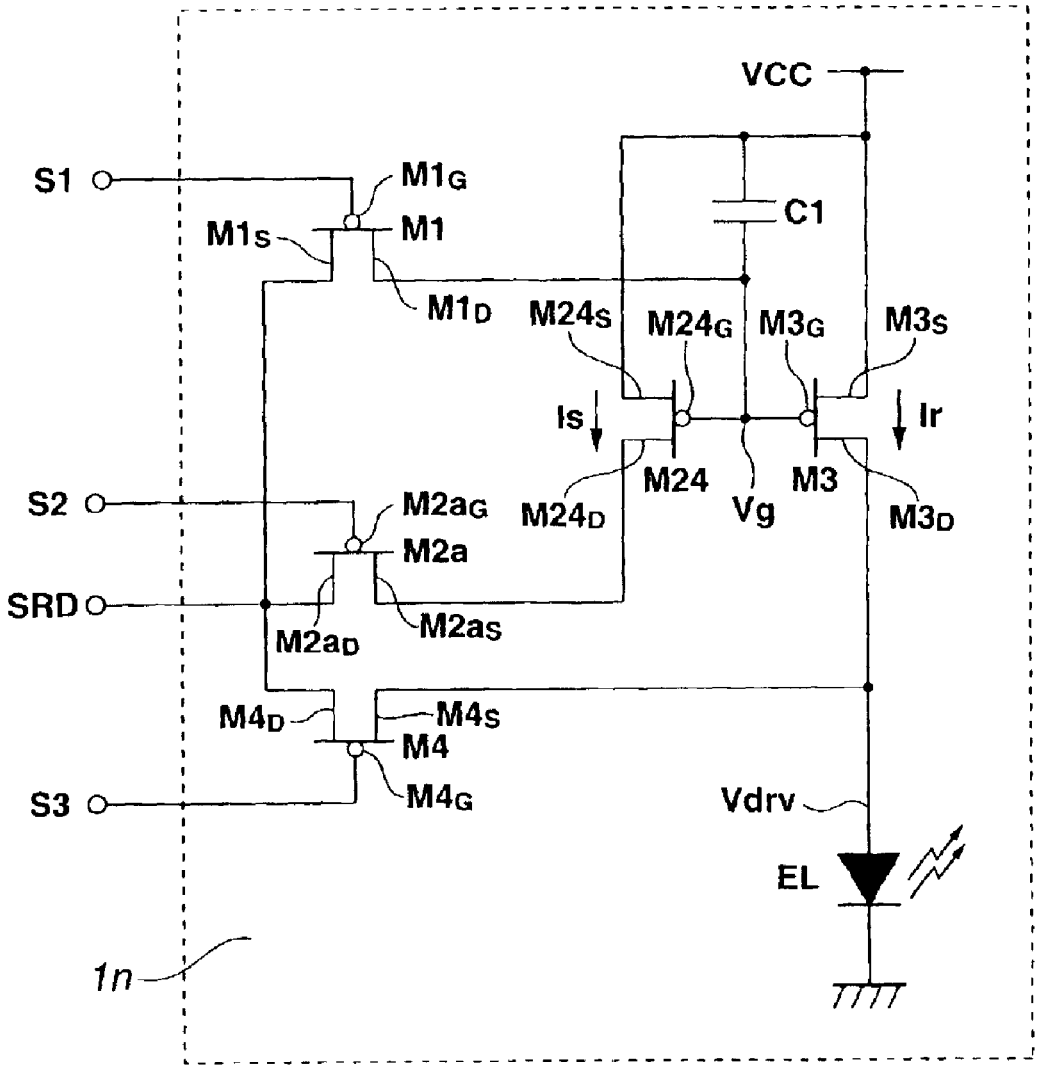
FIG. 11 is a circuit diagram of a current supply circuit included in a driving circuit for a light emitting element according to a third embodiment of the present invention.

FIG. 11 is a circuit diagram of a current supply circuit 1$n$ included in a driving circuit for a light emitting element, according to a third embodiment of the present invention. The display panel system shown in FIG. 17 is comprised of plural current supply circuits 1$n$ and the column-driving control circuits 2$w$.

(Configuration of the Current Supply Circuit 1$n$)

Referring now to FIG. 11, the source terminal $M3_S$ of a p-type transistor M3 is connected to a power supply VCC. The gate terminal $M3_G$ of the p-type transistor M3 is connected to a capacitor C1. Another terminal of the capacitor C1 is connected to the power supply VCC. The drain terminal $M3_D$ of the p-type transistor M3 is connected to a first terminal of the light emitting element EL one of whose terminals is grounded. The drain terminal $M1_D$ of a transistor M1 is connected to the gate terminal $M3_G$ and to the gate terminal $M24_G$ of a transistor M24 whose source is connected to the power supply VCC. A control signal SI is input to the gate terminal $M1_G$ of the transistor M1. The drain terminal $M24_D$ of the transistor M24 is connected to the source terminal $M2a_S$ of a transistor M2$a$. A control signal S2 is input to the gate terminal $M2a_G$ of the transistor M2$a$. The source terminal $M4_S$ of a transistor M4 is connected to the drain terminal $M3_D$ of a transistor M3, and a control signal S3 is input to the gate terminal $M4_G$ of the transistor M4. The drain terminals $M1_D$, $M2_D$ and $M4_D$ are interconnected, and a signal SRD is input thereto.

In the third embodiment, the column-driving control circuit 2$w$ described in the second embodiment is used as the column-driving control circuit, and the voltage-sample-and-hold circuit described in the first embodiment is used as the voltage-sample-and-hold circuit. Accordingly, further explanation of the circuit is omitted.

(Explanation of the Operation)

Figure 12:
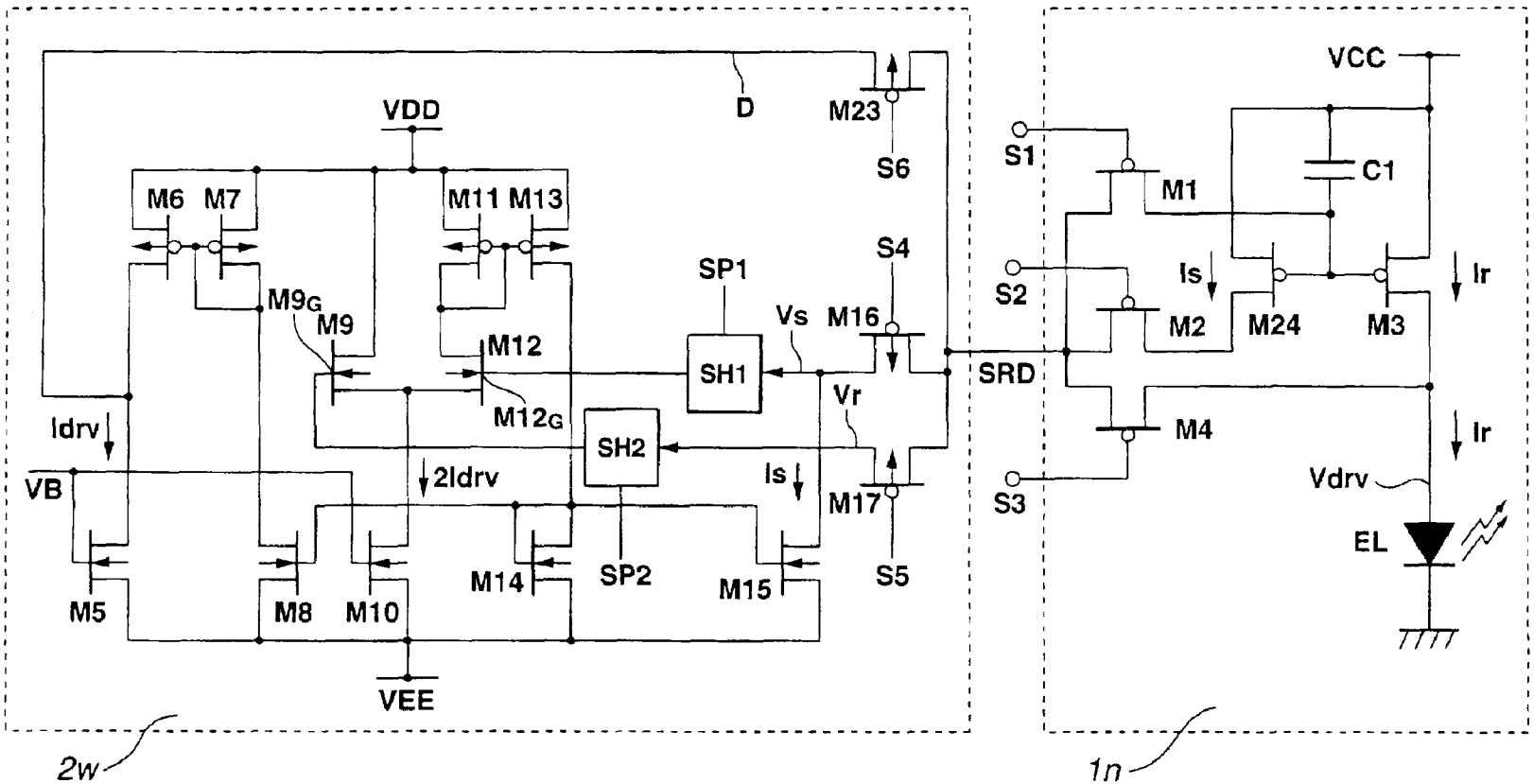
FIG. 12 is a circuit diagram illustrating an emission continuation operation of the driving circuit for the light emitting element according to the third embodiment.

FIG. 12 is a circuit diagram illustrating the light-emission continuation operation of the driving circuit for the light emitting element of the third embodiment. FIGS. 13A–13I are time charts, each illustrating an operation of the driving circuit for the light emitting element of the third embodiment.

A description will now be provided of the operation of control of light emission of the light emitting element performed by the driving control circuit 2$w$ for the corresponding row and the current supply circuit 1$n$ for the corresponding pixel.

<Premise>

In order to facilitate explanation, it is assumed that the size ratio proportional to the ratio between the current driving characteristics of respective transistors is set such that M3=M24, M10=2×M5=2×M15, M6=M7, M9=M12, and M11=M13, and that the on-resistance of each of the transistors M1, M2, M4, M16 and M17 is sufficiently low when the gate voltage of the transistor assumes the L level.

FIGS. 13A–13I are time charts, each illustrating an operation of the circuit shown in FIG. 12.

(1) Before the control period T(n) for the n-th row,

S1($n$)=H→M1=OFF

S2($n$)=H→M2=OFF

S3(*n*)=H→M4=OFF

S4(*n*)=H→M16=OFF

S5(*n*)=H→M17=OFF

S6(*n*)=H→M23=OFF

SP1(*n*)=L→SH1: holding mode

SP2(*n*)=L→SH2: holding mode

At that time, the connection of the column-driving control circuit 2*w* with the corresponding current supply circuit 1*n* disappears, and the current supply circuit 1*n* is in the state shown in FIG. 5. That is, predetermined light emission is performed by the gate-terminal voltage Vg set for injecting an injection current Ir that determines the amount of light emission of the light emitting element set at the immediately preceding period (the immediately preceding frame period).

(2) During the period Ts(n),

S1(*n*)=H→M1=OFF

S2(*n*)=H→M2=OFF

S3(*n*)=H→M4=OFF

S4(*n*)=H→M16=OFF

S5(*n*)=H→M17=OFF

S6(*n*)=H→M23=OFF

SP1(*n*)=L→SH1: holding mode

SP2(*n*)=L→SH2: holding mode

Figures 13A, 13B, 13C, 13D, 13E, 13F, 13G, 13H, 13I:
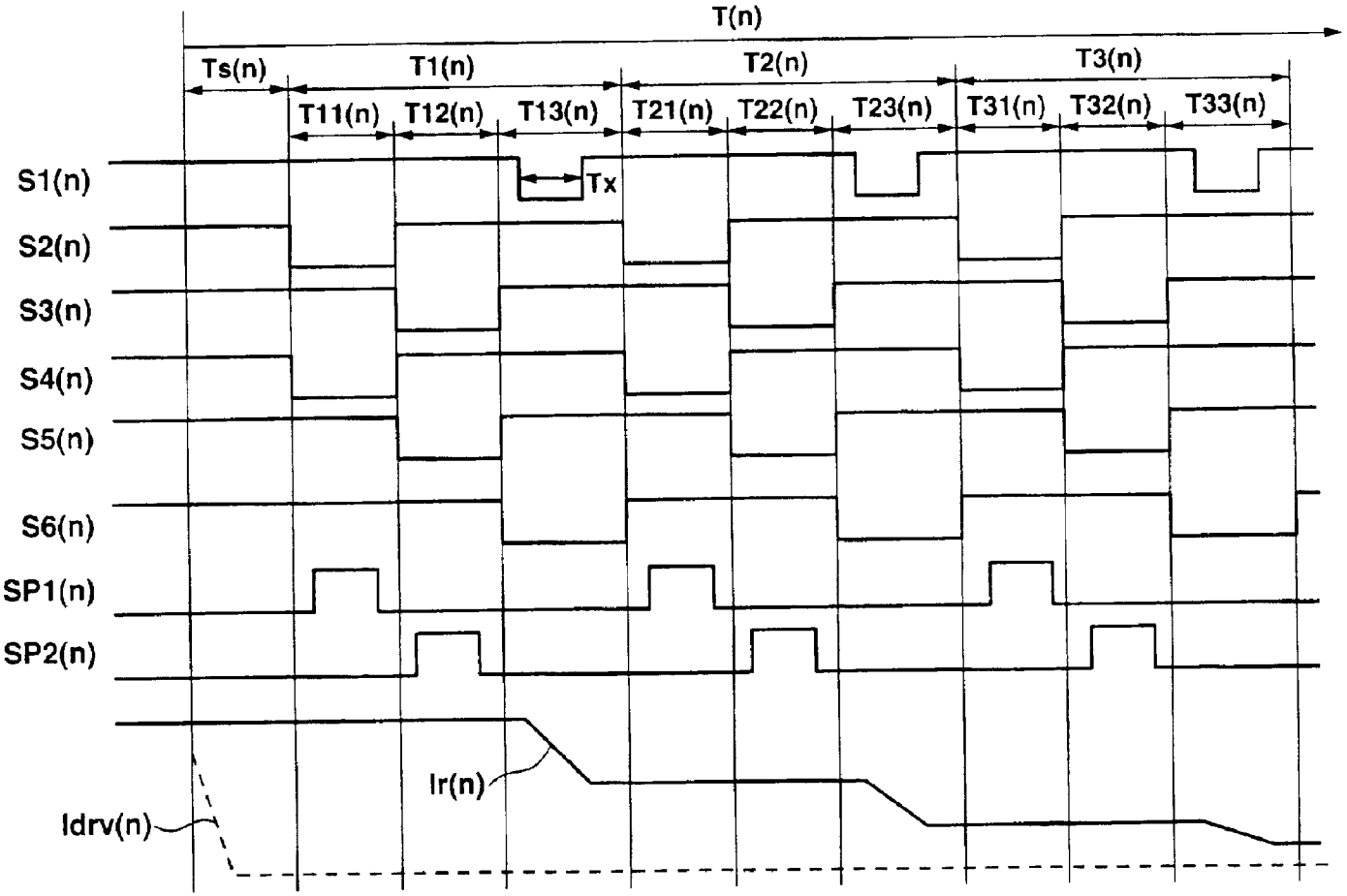
FIGS. 13A–13I are time charts, each illustrating an operation of the driving circuit for the light emitting element according to the third embodiment.
Figure 14:
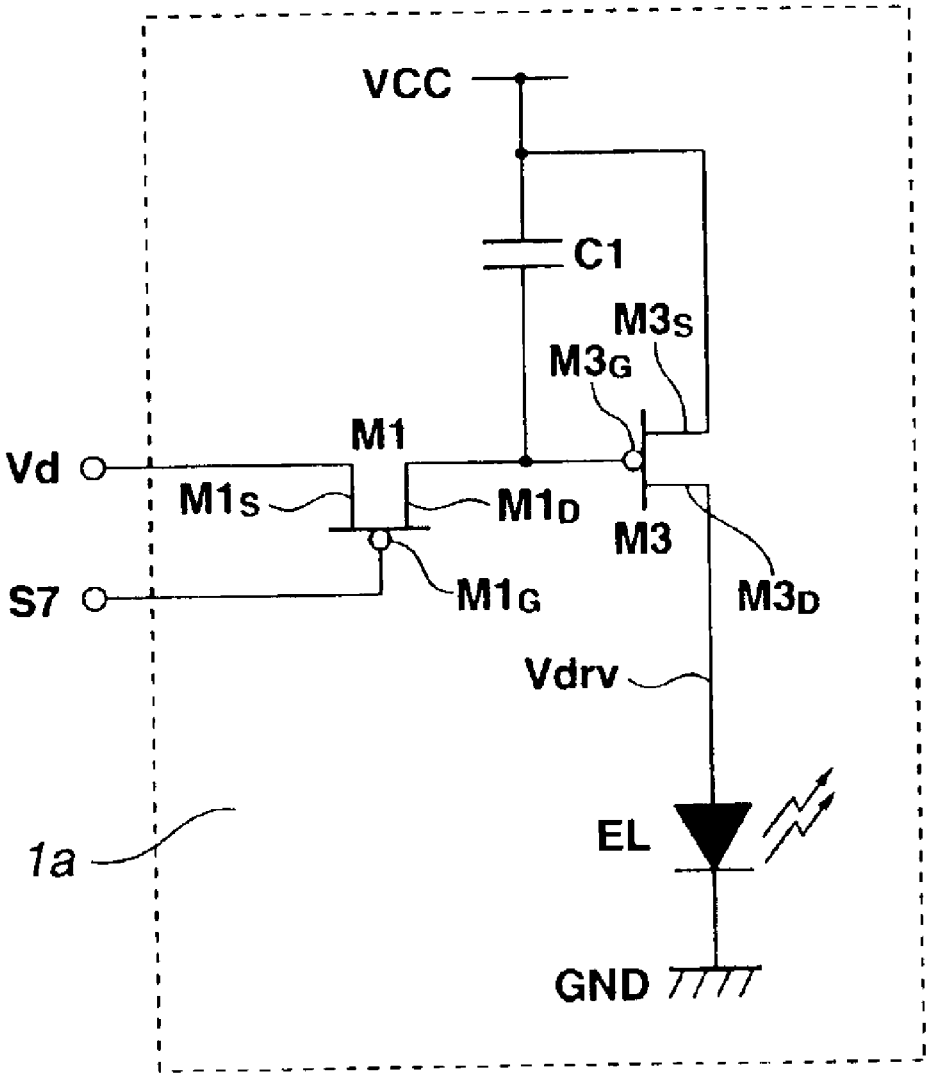
FIG.14 PRIOR ART
FIG. 14 is a current supply circuit included in a driving circuit for a light emitting element according to a conventional approach.
Figure 15:
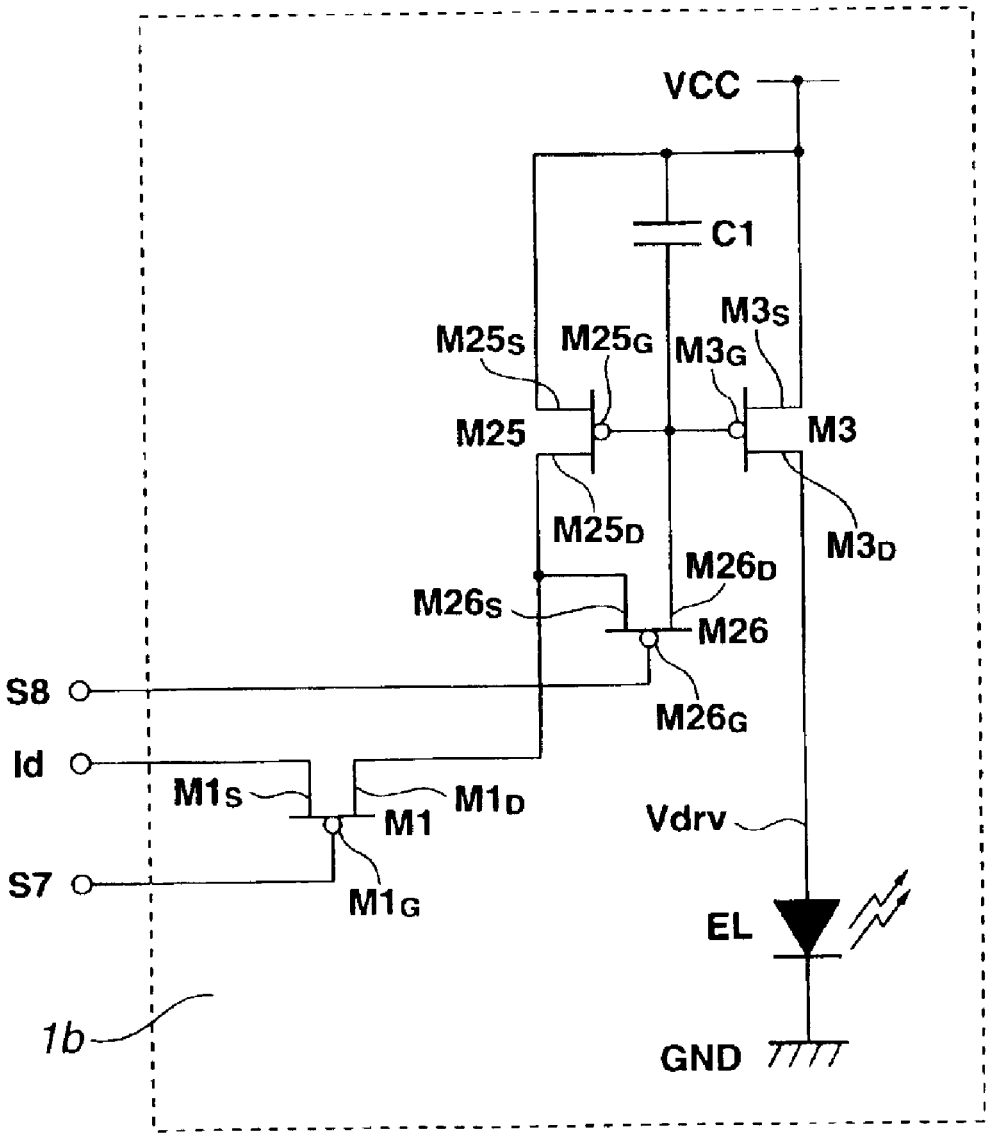
FIG.15 PRIOR ART
FIG. 15 is a current supply circuit included in a driving circuit for a light emitting element according to another conventional approach.
Figure 16:
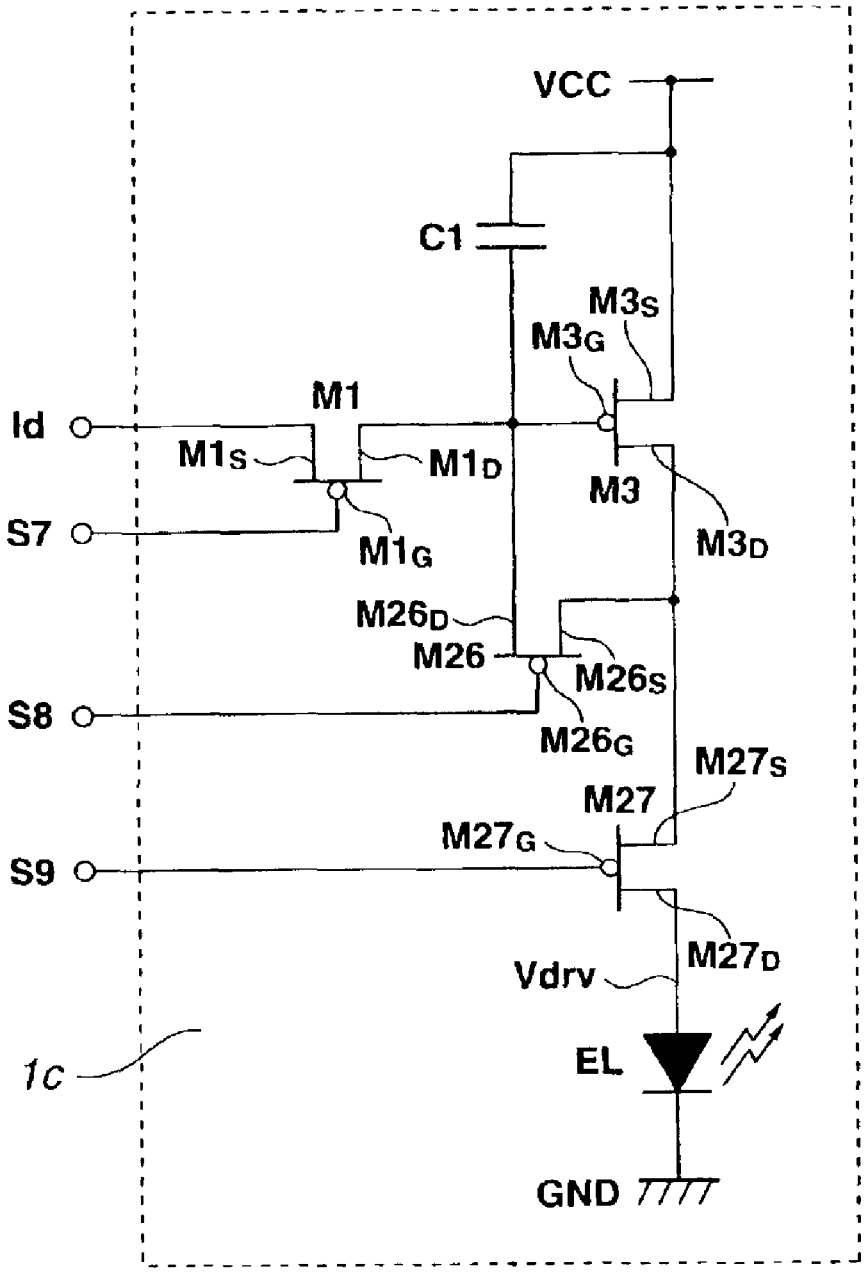
FIG.16 PRIOR ART
FIG. 16 is a current supply circuit included in a driving circuit for a light emitting element according to still another conventional approach.

At that time, resetting of the set current Idrv(n) is performed by the setting signal VB. In the case of FIG. 13I, the setting current Idrv is set to a reduced value.

(3) During the period T11(*n*),

S1(*n*)=H→M1=OFF

S2(*n*)=L→M2=ON

S3(*n*)=H→M4=OFF

S4(*n*)=L→M16=ON

S5(*n*)=H→M17=OFF

S6(*n*)=H→M23=OFF

SP1(*n*)=H→SH1: sampling mode

SP2(*n*)=L→SH2: holding mode

The following assumption is performed.

<Assumption>

It is assumed that both of the SH1 output ($M12_G$) and the SH2 output ($M9_G$) are held to the operational voltage Vdrv of the light emitting element operating by the previously set injection current.

At that time, the current flowing in the transistor M24 is the previously set current Is, and the voltage Vs increases during this period in which the setting current Idrv is reduced. As a result, the gate terminal $M12_G$ is also hold at an increased voltage. Accordingly, the error current D of the row-driving control circuit 2*w* is an up current.

(4) During the period T12(*n*),

S1(*n*)=H→M1=OFF

S2(*n*)=H→M2=OFF

S3(*n*)=L→M4=ON

S4(*n*)=H→M16=OFF

S5(*n*)=L→M17=ON

S6(*n*)=H→M23=OFF

SP1(*n*)=L→SH1: holding mode

SP2(*n*)=H→SH2: sampling mode

At that time, the current of the transistor M3 is injected into the light emitting element, and the operational voltage Vdrv at that time is input to the gate terminal $M9_G$ by the SH2. However, since the current of the transistor M3 equals the immediately preceding injection current Ir, the voltage applied to the gate terminal $M9_G$ equals the previously held voltage. Accordingly, the error current D of the row-driving control circuit 2*w* is an up current.

(5) During the period T13(*n*),

S1(*n*)=L→M1=ON

S2(*n*)=H→M2=OFF

S3(*n*)=H→M4=OFF

S4(*n*)=H→M16=OFF

S5(*n*)=H→M17=OFF

S6(*n*)=L→M23=ON

SP1(*n*)=L→SH1: holding mode

SP2(*n*)=L→SH2: holding mode

At that time, the error current D of the column-driving control circuit 2*w* continues to be an up current, and is supplied to the gate terminal $M3_G$ of the current supply circuit 1*n*, to increase the voltage of this terminal and reduce the current Ir(n) (see FIG. 13I).

(6) During the period T21(*n*),

S1(*n*)=H→M1=OFF

S2(*n*)=L→M2=ON

S3(*n*)=H→M4=OFF

S4(*n*)=L→M16=ON

S5(*n*)=H→M17=OFF

S6(*n*)=H→M23=OFF

SP1(*n*)=H→SH1: sampling mode

SP2(*n*)=L→SH2: holding mode

At that time, since the current Ir(n) flowing in the transistor M3 is smaller than the current during the period T11(*n*), the voltage Vs is smaller than during the period T11(*n*). Hence, the voltage of the gate terminal $M12_G$ is also held to a value smaller than during the period T11(*n*). Accordingly, although the error current D of the column-driving control circuit 2*w* remains to be an up current, the current value is smaller than during the period T11(*n*).

(7) During the period T22(*n*),

S1(*n*)=H→M1=OFF

S2(*n*)=H→M2=OFF

S3(*n*)=L→M4=ON

S4(*n*)=H→M16=OFF

S5(*n*)=L→M17=ON

S6(*n*)=H→M23=OFF

SP1(*n*)=L→SH1: holding mode

SP2(*n*)=H→SH2: sampling mode

At that time, the current of the transistor M3 is injected into the light emitting element, and the operational voltage Vdrv at that time is input to the gate terminal $M9_G$ by the SH2. However, since the current of the transistor M3 is smaller than during the period T12(*n*), the voltage applied to the transistor M3 increases from the voltage held during the period T12(*n*). Accordingly, although the error current D of the column-driving control circuit 2*w* remains to be an up current, the current value is smaller than during the period T12(*n*).

(8) During the period T23(*n*),

S1(*n*)=L→M1=ON

S2(*n*)=H→M2=OFF

S3(*n*)=H→M4=OFF

S4(*n*)=H→M16=OFF

S5(*n*)=H→M17=OFF

S6(*n*)=L→M23=ON

SP1(*n*)=L→SH1: holding mode

SP2(*n*)=L→SH2: holding mode

At that time, the error current D of the column-driving control circuit 2*w* continues to be an up current, and is supplied to the gate terminal $M3_G$ of the current supply circuit 1*n*, to increase the voltage of this terminal and reduce the current Ir(n) (see FIG. 13I). However, since the value of the up current is smaller than during the period T13(*n*), the speed of decrease of the current Ir(n) is smaller than during the period T13(*n*) (see FIG. 13I).

(9) During each of the periods T31(*n*), T32(*n*) and T33(*n*), a similar operation is repeated. The injection current Ir(n) into the light emitting element gradually approaches the setting current Idrv and finally equals the setting current Idrv by further repeating the above-described sequence. Although the frequency of repetition operations may be as large as possible within an allowable range of the system, it is not limited to a certain number. At that time, the voltage Vs equals the voltage Vr. These are conditions with which the above-described assumption holds, and indicate that the foregoing explanation logically holds.

(10) In the succeeding process,

S1(*n*)=H→M1=OFF

S2(*n*)=H→M2=OFF

S3(*n*)=H→M4=OFF

S4(*n*)=H→M16=OFF

S5(*n*)=H→M17=OFF

S6(*n*)=H→M23=OFF

SP1(*n*)=L→SH1: holding mode

SP2(*n*)=L→SH2: holding mode

At that time, since the column-driving control circuit 2*w* is not connected to the current supply circuit for the n-th row, the corresponding current supply circuit 1*n* has the circuit configuration shown in FIG. 5. The current Ir flowing in the transistor M3 continues to be the injection current Ir(n) equal to the setting current Idrv(n), and the light emitting element continues to perform desired light emission. Basically, the above-described operation of setting the injection current Ir to the setting current and the light emission operation of the light emitting element by the set injection current Ir are not influenced by the transistor characteristics, because if the transistors M3 and M24 are closely mounted in the current supply circuit 1*n*, relative current driving characteristics are identical. That is, the same effects as in the second embodiment are obtained.

In addition to the effects of the second embodiment, according to the third embodiment, it is possible to cause the injection current Ir to continue to flow in the light emitting element even during the reference period in which the reference current Is flows in the driving control circuit.

The transistors M1, M2 and M3 of the current supply circuit 1*n* may be replaced by any other circuit configurations that performs a switching operation by inputting appropriate control signals S1, S2 and S3, and that each of the p-type transistors M3 and M24 may be replaced by an n-type transistor by modifying connection to the light emitting element and the configuration of the column-driving control circuit 2*w*. Furthermore, the capacitor C1 may be realized a parasitic capacitance of connected transistors. When the image display unit 4 is arranged to display a color image, then, as shown in FIG. 19, each current supply circuit for one pixel is divided into a current supply circuit 1R for a red pixel, a current supply circuit 1G for a green pixel, and a current supply circuit 1B for a blue pixel. Accordingly, the number of signal lines for column control signals Ai–Ax is three times the number of signal lines in the monochromatic image display panel shown in FIG. 17. In consideration of wire layout on the display panel, it is desirable to minimize the number of signal lines for the column control signals Ai–Ax that are connected to the respective current supply circuits 1*n*. The configuration of the third embodiment is very convenient because only one signal line connecting the column-driving control circuit 2*w* to the current supply circuit 1*n* is required.

As described above, when using the current supply circuits and the column-driving control circuits using the light emitting elements according to the present invention in an image display panel or the like, the following effects are obtained.

(Effect 1)

The light emitting element of each current supply circuit can perform a stable light emitting operation by a set injection current without being influenced by the characteristic values and variations in the characteristic values of the TFT of the current supply circuit.

(Effect 2)

The light emitting element can perform a stable light emitting operation by a set injection current irrespective of variations in the driving voltage depending on the operating state of the light emitting element, and variations in the operating voltage among light emitting elements.

(Effect 3)

As a result, the current driving characteristics of TFT's for driving respective light emitting elements have a margin. Accordingly, the size of each transistor can be greatly reduced, and the size of each TFT circuit can also be reduced.

(Effect 4)

The power supply voltage for driving each light-emitting element can be minimized. As a result, the power consumption of each TFT circuit can be suppressed, resulting in energy saving of the display panel.

(Effect 5)

Since the power consumption of the TFT circuit is suppressed, heat transmission to the light emitting element is reduced. This is very advantageous for the light emitting element that is not heat resistant.

(Effect 6)

The number of column-driving-control-signal lines connected to each current supply circuit can be minimized to one. This is effective particularly in a color display panel in which the layout of column-driving-control wires is very difficult.

The individual components shown in outline or designated by blocks in the drawings are all known in the light-emitting-element driving circuit arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A driving circuit for a current-control-type light emitting element having an emission luminance controlled by a current flow in said light emitting element, said driving circuit comprising:

a current supply circuit configured to supply a current to said light emitting element with a current; and said current supply circuit comprising:

a supply transistor;
a driving switch;
a reference switch;
a control switch; and
a capacitor; and a driving control circuit that controls said current supply circuit, wherein a first terminal of said supply transistor is connected to a first power supply, a second terminal of said supply transistor is connected to a first terminal of said light emitting element via said driving switch and to said driving control circuit via said reference switch, a second terminal of said light emitting element is connected to a second power supply, a gate terminal of said supply transistor is connected to said driving control circuit via said control switch and to a first terminal of said capacitor, and a second terminal of said capacitor is connected to the first terminal of said supply transistor, wherein a path of a current supplied from the first power supply via said supply transistor can be switched between one of a path of an injection current into said light emitting element and a path of a reference current into said driving control circuit, by said driving switch and said reference switch, and a supply-terminal voltage that is a voltage of the second terminal of said supply transistor can be input to said driving control circuit via said reference switch, and wherein, based on the reference current and the supply-terminal voltage input via said reference switch during a reference period in which said driving switch is in an off-state, said reference switch is in an on-state, and said control switch is in an off-state, and the supply-terminal voltage input via said reference switch during a driving period in which said driving switch is in an on-state, said reference switch is in an on-state, said control switch is in an off-state, and a current supplied from the first power supply via said supply transistor flows in said light emitting element as the injection current, said driving control circuit controls a gate-terminal voltage of said supply transistor via said control switch, so that the reference current during the reference period approaches a desired setting current value and that the supply-terminal voltage during the reference period approaches the supply terminal voltage during the driving period.

2. A driving circuit according to claim 1, wherein a connection terminal of said reference switch connecting said reference switch to said driving control circuit and a connection terminal of said control switch connecting said control switch to said driving control circuit are short circuited.

3. A driving circuit for a current-control-type light emitting element having an emission luminance controlled by a current flow in said light emitting element, said driving circuit comprising:

a current supply circuit that supplies a current to said light emitting element, said current supply circuit comprising:
a supply transistor having electric characteristics;
a reference transistor having the electric characteristics of said supply transistor;
a first reference switch;
a second reference switch;
a control switch; and
a capacitor, and a driving control circuit that controls said current supply circuit, wherein a first terminal of said supply transistor is connected to a first power supply, a second terminal of said supply transistor is connected to a first terminal of said light emitting element and to said driving control circuit via said second reference switch, a second terminal of said light emitting element is connected to a second power supply, a gate terminal of said supply transistor is connected to a gate terminal of said reference transistor, to said driving control circuit via said control switch and to a first terminal of said capacitor, a second terminal of said capacitor is connected to the first terminal of said supply transistor, a first terminal of said reference transistor is connected to the first power supply, and a second terminal of said reference transistor is connected to said driving control circuit via said first reference switch, wherein a reference current whose value is the same as an injection current supplied from the first power supply to said light emitting element via said supply transistor can be input to said driving control circuit via said reference transistor, a reference-terminal voltage that is a voltage of the second terminal of said reference transistor can be input to said driving control circuit via said first reference switch, and a supply-terminal voltage that is a voltage of the second terminal of said supply transistor can be input to said driving control circuit via said second reference switch, and wherein, based on the reference current and the reference-terminal voltage input via said first reference switch during a reference period in which said first reference switch is in an on-state, said second reference switch is in an off-state and said control switch is in an off-state, and the supply-terminal voltage input via said second reference switch during a driving period in which said first reference switch is in an off-state, said second reference switch is in an on-state, said control switch is in an off-state, and the injection current flows in said light-emitting element, said driving control circuit controls a gate-terminal voltage of said supply transistor via said control switch, so that the reference current during the reference period approaches a desired setting current value and that the reference-terminal voltage during the reference period approaches the supply-terminal voltage during the driving period.

4. A driving circuit according to claim 3, wherein a connection terminal of said first reference switch connecting said first reference switch to said driving control circuit and a connection terminal of said second reference switch connecting said second reference switch to said driving control circuit are short circuited.

5. A driving circuit according to claim 3, wherein a connection terminal of said first reference switch connecting said first reference switch to said driving control circuit, a connection terminal of said second reference switch connecting said second reference switch to said driving control circuit, and a connection terminal of said control switch connecting said control switch to said driving control circuit are short circuited.

6. A light emitting system comprising at least a plurality of light emitting-element driving circuits according to claim 1.

7. A light emitting system comprising at least a plurality of light emitting-element driving circuits according to claim 3.

8. A method of driving a current-control-type light emitting element having an emission luminance controlled by a current flow in the light emitting element, said driving method comprising the steps of:

supplying a current to a light emitting element via a current supply circuit comprising:

a supply transistor;

a driving switch;

a reference switch;

a control switch; and a capacitor; and controlling the current supply circuit via a driving control circuit, wherein a first terminal of the supply transistor is connected to a first power supply, a second terminal of the supply transistor is connected to a first terminal of the light emitting element via the driving switch and to the driving control circuit via the reference switch, a second terminal of the light emitting element is connected to a second power supply, a gate terminal of the supply transistor is connected to the driving control circuit via the control switch and to a first terminal of the capacitor, and a second terminal of the capacitor is connected to the first terminal of the supply transistor, wherein a path of a current supplied from the first power supply via the supply transistor can be switched between one of a path of an injection current into the light emitting element and a path of a reference current into the driving control circuit, by the driving switch and the reference switch, and a supply-terminal voltage that is a voltage of the second terminal of the supply transistor can be input to the driving control circuit via the reference switch, wherein, based on the reference current and the supply-terminal voltage input via the reference switch during a reference period in which the driving switch is in an off-state, the reference switch is in an on-state, and the control switch is in an off-state, and the supply-terminal voltage input via the reference switch during a driving period in which the driving switch is in an on-state, the reference switch is in an on-state, the control switch is in an off-state, and a current supplied from the first power supply via the supply transistor flows in the light emitting element as the injection current, the driving control circuit controls a gate-terminal voltage of the supply transistor via the control switch, so that the reference current during the reference period approaches a desired setting current value and that the supply-terminal voltage during the reference period approaches the supply terminal voltage during the driving period.

9. A method of driving a current-control-type light emitting element having an emission luminance controlled by a current flow in said light emitting element, said driving method comprising the steps of:

supplying a current to a light emitting element via a current supply circuit comprising:

a supply transistor having electric characteristics;

a reference transistor having the electric characteristics of said supply transistor;

a first reference switch;

a second reference switch;

a control switch; and a capacitor; and controlling the current supply circuit via a driving control circuit, wherein a first terminal of the supply transistor is connected to a first power supply, a second terminal of the supply transistor is connected to a first terminal of the light emitting element and to the driving control circuit via the second reference switch, a second terminal of the light emitting element is connected to a second power supply, a gate terminal of the supply transistor is connected to a gate terminal of the reference transistor, to the driving control circuit via the control switch and to a first terminal of the capacitor, a second terminal of the capacitor is connected to the first terminal of the supply transistor, a first terminal of the reference transistor is connected to the first power supply, and a second terminal of the reference transistor is connected to the driving control circuit via the first reference switch, wherein a reference current whose value is the same as an injection current supplied from the first power supply to the light emitting element via the supply transistor can be input to the driving control circuit via the reference transistor, a reference-terminal voltage that is a voltage of the second terminal of the reference transistor can be input to the driving control circuit via the first reference switch, and a supply-terminal voltage that is a voltage of the second terminal of the supply transistor can be input to the driving control circuit via the second reference switch, and wherein, based on the reference current and the reference-terminal voltage input via the first reference switch during a reference period in which the first reference switch is in an on-state, the second reference switch is in an off-state and the control switch is in an off-state, and the supply-terminal voltage input via the second reference switch during a driving period in which the first reference switch is in an off-state, the second reference switch is in an on-state, the control switch is in an off-state, and the injection current flows in the light emitting element, the driving control circuit controls a gate-terminal voltage of the supply transistor via the control switch, so that the reference current during the reference period approaches a desired setting current value and that the reference-terminal voltage during the reference period approaches the supply-terminal voltage during the driving period.

10. A computer readable storage medium storing computer code for executing a method of driving a current-control-type light emitting element having an emission luminance controlled by a current flow in the light emitting element, said method comprising the steps of:

supplying a current to a light emitting element via a current supply circuit comprising:

a supply transistor;

a driving switch;

a reference switch;

a control switch; and a capacitor; and controlling the current supply circuit via a driving control circuit, wherein a first terminal of the supply transistor is connected to a first power supply, a second terminal of the supply transistor is connected to a first terminal of the light emitting element via the driving switch and to the driving control circuit via the reference switch, a second terminal of the light emitting element is connected to a second power supply, a gate terminal of the supply transistor is connected to the driving control circuit via the control switch and to a first terminal of the capacitor, and a second terminal of the capacitor is connected to the first terminal of the supply transistor, wherein a path of a current supplied from the first power supply via the supply transistor can be switched between one of a path of an injection current into the light emitting element and a path of a reference current into the driving control circuit, by the driving switch and the reference switch, and a supply-terminal voltage that is a voltage of the second terminal of the supply transistor can be input to the driving control circuit via the reference switch, and wherein, based on the reference current and the supply-terminal voltage input via the reference switch during a reference period in which the driving switch is in an off-state, the reference switch is in an on-state, and the control switch is in an off-state, and the supply-terminal voltage input via the reference switch during a driving period in which the driving switch is in an on-state, the reference switch is in an on-state, the control switch is in an off-state, and a current supplied from the first power supply via the supply transistor flows in the light emitting element as the injection current, the driving control circuit controls a gate-terminal voltage of the supply transistor via the control switch, so that the reference current during the reference period approaches a desired setting current value and that the supply-terminal voltage during the reference period approaches the supply terminal voltage during the driving period.

11. A computer-readable storage medium storing computer code for executing a method of a current-control-type light emitting element having an emission luminance controlled by a current flow in the light emitting element, said driving method comprising the steps of:

supplying a current to a light emitting element via a current supply circuit comprising:

a supply transistor having electric characteristics;

a reference transistor having the electric characteristics of the supply transistor;

a first reference switch;

a second reference switch;

a control switch; and a capacitor; and controlling the current supply circuit via a driving control circuit, wherein a first terminal of the supply transistor is connected to a first power supply, a second terminal of the supply transistor is connected to a first terminal of the light emitting element and to the driving control circuit via the second reference switch, a second terminal of the light emitting element is connected to a second power supply, a gate terminal of the supply transistor is connected to a gate terminal of the reference transistor, to the driving control circuit via the control switch and to a first terminal of the capacitor, a second terminal of the capacitor is connected to the first terminal of the supply transistor, a first terminal of the reference transistor is connected to the first power supply, and a second terminal of the reference transistor is connected to the driving control circuit via the first reference switch, wherein a reference current whose value is the same as an injection current supplied from the first power supply to the light emitting element via the supply transistor can be input to the driving control circuit via the reference transistor, a reference-terminal voltage that is a voltage of the second terminal of the reference transistor can be input to the driving control circuit via the first reference switch, and a supply-terminal voltage that is a voltage of the second terminal of the supply transistor can be input to the driving control circuit via the second reference switch, and wherein, based on the reference current and the reference-terminal voltage input via the first reference switch during a reference period in which the first reference switch is in an on-state, the second reference switch is in an off-state and the control switch is in an off-state, and the supply-terminal voltage input via the second reference switch during a driving period in which the first reference switch is in an off-state, the second reference switch is in an on-state, the control switch is in an off-state, and the injection current flows in the light emitting element, the driving control circuit controls a gate-terminal voltage of the supply transistor via the control switch, so that the reference current during the reference period approaches a desired setting current value and that the reference-terminal voltage during the reference period approaches the supply-terminal voltage during the driving period.

* * * * *